US008055179B2

(12) United States Patent
Sunada et al.

(10) Patent No.: US 8,055,179 B2
(45) Date of Patent: Nov. 8, 2011

(54) IMAGE FORMING APPARATUS, METHOD THEREFOR, AND PROGRAM

(75) Inventors: Hidenori Sunada, Toride (JP); Kiyoshi Okamoto, Moriya (JP); Mitsuhiko Sato, Kashiwa (JP); Yuichiro Maeda, Kashiwa (JP); Kiyoharu Kakomura, Toride (JP)

(73) Assignee: Canon Kabushiki Kaisha (JP)

( * ) Notice: Subject to any disclaimer, the term of this patent is extended or adjusted under 35 U.S.C. 154(b) by 587 days.

(21) Appl. No.: 12/273,656

(22) Filed: Nov. 19, 2008

(65) Prior Publication Data

US 2009/0129806 A1 May 21, 2009

(30) Foreign Application Priority Data

Nov. 19, 2007 (JP) ..... 2007-299652

(51) Int. Cl.
*G03G 15/00* (2006.01)

(52) U.S. Cl. ..... 399/364

(58) Field of Classification Search ..... 399/82, 399/364, 401

See application file for complete search history.

(56) References Cited

U.S. PATENT DOCUMENTS 4,935,786 A 6/1990 Veeder
6,839,078 B2 1/2005 Izumiya et al.
2008/0253818 A1* 10/2008 Sasaki et al. ..... 399/401

* cited by examiner

*Primary Examiner* — David Gray
*Assistant Examiner* — Barnabas Fekete
(74) *Attorney, Agent, or Firm* — Rossi, Kimms & McDowell LLP

(57) ABSTRACT

An image forming apparatus capable of efficiently performing an image forming processing even in a case where a post-processing apparatus performs a post-processing during a both-sides printing. A first time period needed by a first both-sides image forming processing and a second time period needed by a second both-sides image forming processing are computed in a case where a post-processing unit performs a post-processing on a recording sheet formed images on both sides thereof. The first time period and the second time period is compared, and any one of the first both-sides image forming processing and the second both-sides image forming processing is selected based on the comparison.

9 Claims, 21 Drawing Sheets

$$T1 = \frac{(Nblock-1) \times Tsingle + (Nblock-1) \times Tfin + (Tsingle + Tspeed) \times 2}{Nblock \times 2}$$

WHERE $Tfin < (Nblock+1) \times Tsingle + Tspeed \times 2$ $$T2 = Tsingle + Tspeed$$

WHERE $Tfin < (Tsingle + Tspeed) \times 2$

IMAGE FORMING APPARATUS, METHOD THEREFOR, AND PROGRAM

BACKGROUND OF THE INVENTION

1. Field of the Invention

The present invention relates to an image forming apparatus, capable of performing both-sides printing on a recording sheet, a method therefor, and a program.

2. Description of the Related Art

In a case where a conventional image forming apparatus performs both-sides printing on recording sheets, a both-sides printing method is known that as an initial step, an image is formed on the first surface of each of some recording sheets and thereafter as a subsequent step, an image is alternately formed on the first surface of a recording sheet and second surface of a recording sheet (for example, see, U.S. Pat. No. 4,935,786).

There exists an image forming apparatus capable of connecting to various kinds of post-processing apparatuses. In a case where the image forming apparatus is connected to a post-processing apparatus performing a stapling processing and/or a post-processing apparatus performing a sorting processing, a processing capacity for each of the post-processing apparatuses per unit time is made higher than an image forming capability of the image forming apparatus so as to prevent the image forming apparatus from being kept waiting for an image forming processing thereof. On the other hand, in a case where the image forming apparatus is connected to a post-processing apparatus performing a time-consuming processing on the assumption of being performed a both-sides printing mode such as a bookbinding function, the post-processing apparatus is made to have a capability half of or more than half of an image forming capability of the image forming apparatus in a one-side printing mode so as to substantially prevent the image forming apparatus from being kept waiting for the image forming processing thereof.

In the meantime, recently, the image forming apparatus is required to improve image quality for the both-sides printing thereof, and a problem is pointed out that images formed on the first and second surfaces have different sizes from each other because a recording sheet shrinks during thermal fixing performed along with the image formation on the first surface of the recording sheet. In order to cope with this problem, a method is proposed to switch a rotational speed of a polygon mirror for the image formation between the first and second surfaces (for example, see, U.S. Pat. No. 6,839,078).

A high-speed image forming apparatus requiring high-quality images needs to have a configuration to change the rotational speed of the polygon mirror during the both-sides printing. However, it needs a lot of time to change the rotational speed of the polygon mirror because the polygon mirror is made to have a large inertia to stably rotate at a high speed. As a result, in a case where the image formation on the first and second surfaces of a recording sheet are alternately performed sheet by sheet, it is necessary to perform a speed-changing processing of the polygon mirror at every such occasion, thereby making the image forming processing itself of the image forming apparatus becomes slower.

This problem can be solved by performing the image formation on the first surfaces of a plurality of sheets at one time and subsequently performing the image formation on the second surfaces at one time instead of alternately performing the image formation on the first and second surfaces. This is because, if such configuration is employed, the rotational speed of the polygon mirror changes for less number of times, the image forming apparatus can reduce a time period for the image forming processing.

However, the image forming apparatus having the configuration as described above successively performs the image formation on the second surfaces of the plurality of recording sheets. Accordingly, in a case where a post-processing is performed by a post-processing apparatus having a processing capability half of a processing capability of the image forming apparatus in a one-side printing mode, the post-processing apparatus may cause the image forming apparatus to be kept waiting for the image forming processing thereof. In addition, it becomes necessary for the post-processing apparatus to be provided with a buffer for storing the recording sheets so that the post-processing can be done while the image forming apparatus is performing the image formation on the first surfaces.

On the other hand, when the image formation is performed on thick sheets, the number of the sheets for image formation per unit time may sometimes be reduced so that a fixing unit can apply sufficient heat to the thick sheet. In such case, it is less likely to cause the image forming apparatus to be kept waiting for the image forming processing even where the image formation is performed alternately on the first and second surfaces to repeatedly change the rotational speed of the polygon mirror, and even where a time-consuming post-processing is executed, waiting time for the processing can be reduced.

SUMMARY OF THE INVENTION

The present invention is made in consideration of the above problems, and provides an image forming apparatus capable of efficiently performing an image forming processing even in a case where a post-processing apparatus performs a post-processing during a both-sides printing, a method therefor, and a program.

In a first aspect of the present invention, there is provided with an image forming apparatus comprising a first feeding unit adapted to feed a recording sheet from a container containing the recording sheet, an image forming unit adapted to form an image on the recording sheet, a second feeding unit adapted to re-feed to the image forming unit the recording sheet having the image formed on a first surface thereof by the image forming unit so that an image is formed on a second surface opposite to the first surface, a post-processing unit adapted to perform a post-processing on the recording sheet having an image formed thereon, a both-sides image formation control unit adapted to perform either of a first both-sides image forming processing or a second both-sides image forming processing by controlling the image forming unit, the first feeding unit, and the second feeding unit, wherein the first both-sides image forming processing controls, for at least one time, the first feeding unit to successively feed a plurality of recording sheets, and the image forming unit to successively form an image on the first surface of each of the plurality of recording sheets, thereafter the second feeding unit to feed the plurality of recording sheets, and the image forming unit to successively form an image on the second surface of each of the plurality of recording sheets, and the second both-sides image forming processing controls the first feeding unit to successively feed a predetermined number of recording sheets, the image forming unit to successively form an image on the first surface of each of the recording sheets, thereafter the second feeding unit and the first feeding unit to alternately feed the recording sheets, the image forming unit to alternately form an image on the second surface of the recording sheet fed from the second feeding unit and form an image on the first surface of the recording sheet fed from the first feeding unit, thereafter the second feeding unit to feed the predetermined number of recording sheets, and the image forming unit to form an image on the second surface of each of the recording sheets, a time period computing unit adapted to compute a first time period needed by the first both-sides image forming processing and a second time period needed by the second both-sides image forming processing in a case where the post-processing unit performs the post-processing on the recording sheet formed images on both sides thereof, and a both-sides image forming processing selection unit adapted to compare the first time period and the second time period computed by the time period computing unit and adapted to select any one of the first both-sides image forming processing and the second both-sides image forming processing based on the comparison.

The present invention enables efficiently performing the image forming processing even in a case where the post-processing apparatus performs the post-processing during the both-sides printing.

The above and other objects, features, and advantages of the invention will become more apparent from the following detailed description taken in conjunction with the accompanying drawings.

BRIEF DESCRIPTION OF THE DRAWINGS

FIG. 14A shows a case of the block circulation. FIG. 14B shows a case of the alternate circulation.

FIG. 20A shows a case of the block circulation. FIG. 20B shows a case of the alternate circulation.

DETAILED DESCRIPTION OF THE PREFERRED EMBODIMENTS

The present invention will now be described in detail with reference to the drawings showing preferred embodiments thereof. It should be noted that the relative arrangement of the components, the numerical expressions and numerical values set forth in these embodiments do not limit the scope of the present invention unless it is specifically stated otherwise.

First Embodiment

Figure 1:
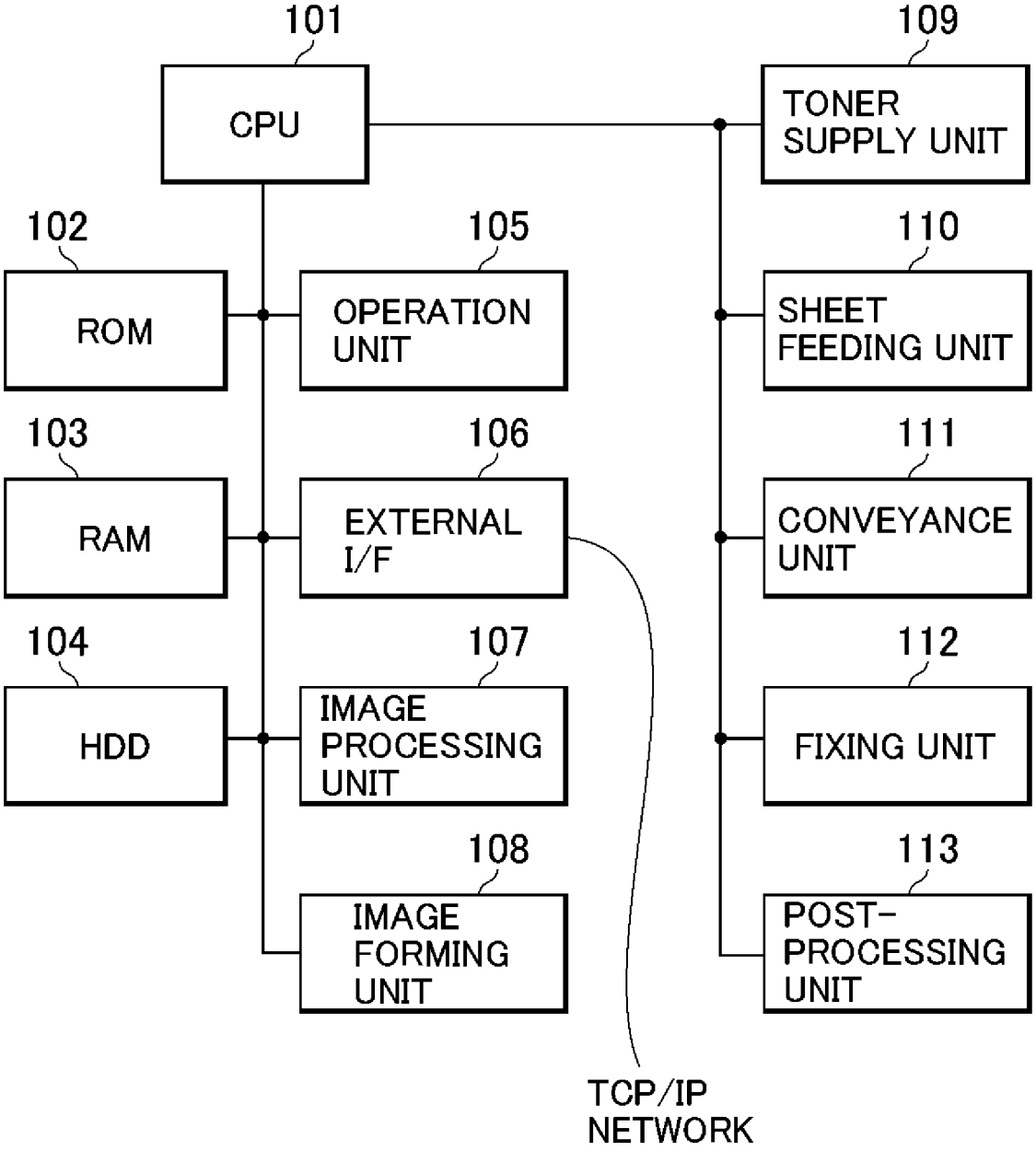
FIG. 1 is a functional block diagram showing a digital printing machine as an example of an image forming apparatus according to an embodiment of the present invention.

FIG. 1 is a functional block diagram showing a digital printing machine as an example of an image forming apparatus according to an embodiment of the present invention.

In FIG. 1, a numeral 101 denotes a CPU performing all controls of the digital printing machine, and a numeral 102 denotes a ROM storing control content to be executed by the CPU 101 and a data to be controlled thereby. A numeral 103 denotes a RAM used as a work area needed for the CPU 101 to control the digital printing machine. The RAM 103 is used not only as the work area for the CPU 101 but also as a work area for allowing an image processing unit 107 to perform an image processing on digital image data obtained via an external I/F 106. The digital image subjected to image processing in the image processing unit 107 is compressed and stored in an HOD 104.

A numeral 105 denotes an operation unit for configuring a print job which an operator wants to execute on the digital printing machine. A later-described post-processing can be configured with the operation unit 105. The external I/F 106 is connected to a network based on TCP/IP and the like. A computer (not shown) connected to the network transmits an execution instruction of the print job and obtains information such as a remaining amount of a consumable and the like via the external I/P 106.

As described above, the image processing unit 107 performs the required image processing on the digital image data received via the external I/F 106, and stores the digital image data to the HDD 104. In addition, according to a content of configuration of the print job inputted from the operation unit 105, the image processing unit 107 reads the digital image data from the HDD 104, and performs a processing to expand the digital image data on the RAM 103 upon performing a predetermined image processing on the digital image data having been read out.

Based on the content of configuration of the print job, an image forming unit 108 forms a toner image derived from the digital image data expanded on the RAM 103. As necessary, a toner supply unit 109 supplies, from a toner bottle (not shown), toner to be consumed by the image forming unit 108. On the other hand, a sheet feeding unit 110 feeds a recording sheet contained in the digital printing machine, and subsequently, a conveyance unit 111 conveys the recording sheet to the image forming unit 108. Then, the toner image formed by the image forming unit 108 is transferred onto the recording sheet. It should be noted that the recording sheet may also be referred to as a sheet, a recording medium, and paper.

A fixing unit 112 fixes the toner image having been transferred on the recording sheet, and the recording sheet is conveyed toward a post-processing unit 113. In a case where an image is to be formed also on a back surface of the recording sheet, the recording sheet is conveyed toward the image forming unit 108 via the conveyance unit 111.

The post-processing unit 113 performs a post-processing, based on the configuration of the print job, on the recording sheet having the image formed thereon. The post-processing can involve, for example, a stapling processing for binding a corner of a bundle of recording sheets with a staple, a punching processing for punching holes on each end portion of the recording sheets, a center-binding processing for binding a central portion of a bundle of recording sheets and folding the recording sheets into two.

Figure 2:
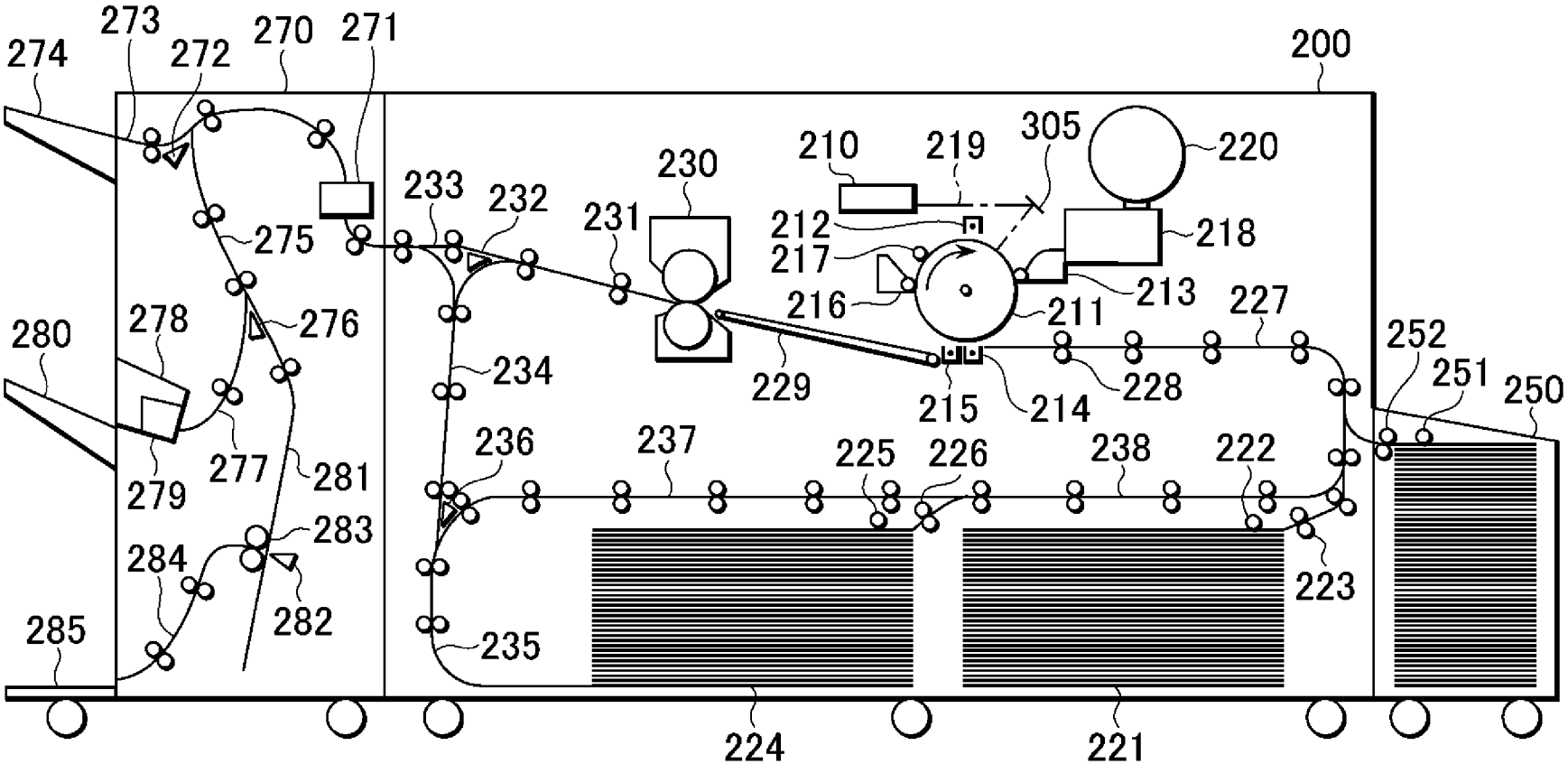
FIG. 2 is a longitudinal sectional view showing an internal structure of the digital printing machine of FIG. 1.

FIG. 2 is a longitudinal sectional view showing an internal structure of the digital printing machine of FIG. 1.

In FIG. 2, a numeral 200 denotes a main body of the digital printing machine, and a numeral 250 denotes a side sheet deck. A numeral 210 denotes a laser scanner made up with a laser, a polygon mirror, and the like. The laser scanner 210 emits to a photosensitive drum 211, serving as an image bearing member, a laser light 219 modulated based on an image signal generated through an predetermined image processing performed on image information such as the digital image data and the like contained in the RAM 103 and the HDD 104 by the image processing unit 107. A first charging device 212, a developing device 213, a transfer charging device 214, a separation charging device 215, a cleaning apparatus 216, and a pre-exposure lamp 217 are arranged around the photosensitive drum 211.

The photosensitive drum 211 is rotated by a motor, not shown, in a direction of an arrow indicated in FIG. 2. After the first charging device 212 charges the surface of the photosensitive drum 211 to a desired electric potential, the laser scanner 210 emits the laser light 219 to the surface of the photosensitive drum 211, so that a latent image is formed on the surface of the photosensitive drum 211. The latent image formed on the photosensitive drum 211 is developed by the developing device 213 and becomes visible as a toner image. When a toner sensor, not shown, in the developing device 213 detects that the developing device 213 runs out of toner, the toner is supplied from a toner buffer 218 to the developing device 213.

In addition, when only a little toner remains in the toner buffer 218, a motor, not shown, rotates the toner bottle 220 to cause the toner contained in the toner bottle 220 to be dropped into the toner buffer 218, so that the toner is supplied to the toner buffer 218. In a case where the toner sensor detects that there remains only a little toner in the toner buffer 218 even where the toner bottle is rotated for a predetermined time, a message to the effect that it is necessary to replace the toner bottle is notified to an operator via the operation unit 105.

On the other hand, the recording sheet fed with a pickup roller 222 from a right deck 221 is forwarded with feeding rollers 223 to a main conveyance path 227. The recording sheet contained in a left deck 224 is fed with a pickup roller 225 and is forwarded with feeding rollers 226 to the main conveyance path 227 via a re-feeding path 238. Similarly, the recording sheet contained in a side sheet deck 250 is fed with a pickup roller 251 and is forwarded with feeding rollers 252 to the main conveyance path 227. It should be noted that the right deck 221, the left deck 224, the side sheet deck 250, the pickup rollers 222, 225, 251, the feeding rollers 223, 226, 252, and motors (not shown) for diving each roller correspond to the feeding unit 110 shown in FIG. 1.

The recording sheet forwarded to the main conveyance path 227 is forwarded with registration rollers 228 to a transfer unit, and the transfer charging device 214 transfers the toner image formed on the photosensitive drum 211 onto the recording sheet. After the toner image is transferred onto the recording sheet, the cleaning apparatus 216 cleans residual toner from the photosensitive drum 211, and the pre-exposure lamp 217 erases residual electric charge.

The recording sheet having the toner image transferred thereon is separated by the separation charging device 215 from the photosensitive drum 211, and is conveyed by a conveyance belt 229 to the fixing device 230 directly. The recording sheet forwarded to the fixing device 230 is applied with pressure and heat, so that the toner image transferred thereon is fixed. Then, the recording sheet is conveyed to an external sheet discharging path 233 via internal sheet discharging rollers 231, and is discharged out of the digital printing machine 200. It should be noted that the laser scanner 210, the first charging device 212, the developing device 213, the transfer charging device 214, the separation charging device 215, the cleaning apparatus 216, the pre-exposure lamp 217, and the like arranged around the photosensitive drum 211 correspond to the image forming unit 108 shown in FIG. 1.

A sheet discharging flapper 232 switches a path between a reversing path 234 and an external sheet discharging path 233. The recording sheet can be reversed and discharged out of the apparatus by switching a tip of the sheet discharging flapper 232 to the upper side, conveying the recording sheet having passed through the fixing device 230 into the reversing path 234, and thereafter immediately rotating a roller on the path in an opposite direction to convey the recording sheet to the external sheet discharging path 233.

On the other hand, in a case where a both-sides printing is performed on the recording sheet, the recording sheet conveyed into the reversing path 234 is conveyed into a both-sides reversing path 235. Thereafter, a both-sides flapper 236 is switched, and a roller on the both-sides reversing path 235 is rotated in an opposite direction, so that the recording sheet is reversed and is conveyed to a lower conveyance path 237. A conveyance speed of the recording sheet in the reversing path 234, the both-sides reversing path 235, and the lower conveyance path 237 is set to be twice as fast as a conveyance speed for conveying the recording sheet around the fixing device 230. Accordingly, an interval between recording sheets is narrower when the recording sheet passes through the fixing device 230. But thereafter, the recording sheet is conveyed at a faster speed to increase the interval between sheets, so that the recording sheet can be successively conveyed into the lower conveyance path 237. The recording sheet conveyed to the lower conveyance path 237 is conveyed to the re-feeding path 238 directly, and is further conveyed by way of the main conveyance path 227, and a toner image is transferred onto the second surface in the both-sides printing. It should be noted that various rollers, flappers, driving motors therefor, and the like arranged on the main conveyance path 227, the reversing path 234, the both-sides reversing path 235, the lower conveyance path 237, and the external sheet discharging path 233 correspond to the conveyance unit 111 shown in FIG. 1.

A numeral 270 denotes a finisher for aligning and stacking the recording sheet discharged out of the digital printing machine 200. The recording sheet discharged sheet by sheet out of the external sheet discharging path 233 of the digital printing machine 200 is discharged to either of the sheet discharging trays 274, 280, 285. It should be noted that the finisher 270 corresponds to the post-processing unit 113 shown in FIG. 1. The sheet discharging trays 274, 280 can be moved up and down by a motor, not shown. Especially, the sheet discharging tray 274 can be lowered as low as a position of a processing tray 278. In a case where many recording sheets are stacked on the sheet discharging trays 274, 280, a position of the sheet discharging tray may be lowered, so that a position of a top sheet surface on the sheet discharging tray is aligned with a sample tray path 273 or the processing tray 278. This finisher 270 can perform the post-processing, i.e., the punching processing, the stapling processing, and the center-binding processing.

In a case where the print job specifies a hole-punching, a punching unit 271 punches holes on the recording sheet conveyed to the finisher 270 via the external sheet discharging path 233. Thereafter, a sample sheet discharging flapper 272 switches between the sample tray path 273 and a processing tray path 275. In a case where the recording sheet is conveyed to the sample tray path 273, the recording sheet is discharged to the sheet discharging tray 274 directly.

In a case where the recording sheet is conveyed to the processing tray path 275, a saddle flapper 276 switches a path therebeyond to either of the processing tray path 277 or a saddle path 281. In a case where the path is switched to the processing tray path 277, the recording sheet is discharged to the processing tray 278, and a stapling unit 279 executes the desired stapling processing according to a stapling specification for the recording sheet when a bundle of recording sheets gets together. Thereafter, when the processing is completed, the recording sheet is discharged to the previously specified sheet discharging tray 274 or the sheet discharging tray 280.

A stapling unit, not shown, binds a center of the recording sheet conveyed to the saddle path 281 when a bundle of recording sheets gets together. Thereafter, a thrusting unit 282 thrusts the central portion of the bundle of recording sheets toward a left direction in FIG. 2, and the bundle of recording sheets is folded into two at the central portion with folding rollers 283, so that the bundle of recording sheets is bound into a book. The folded book bundle is discharged through a binding path 284 to the saddle discharging tray 285.

Figure 3:
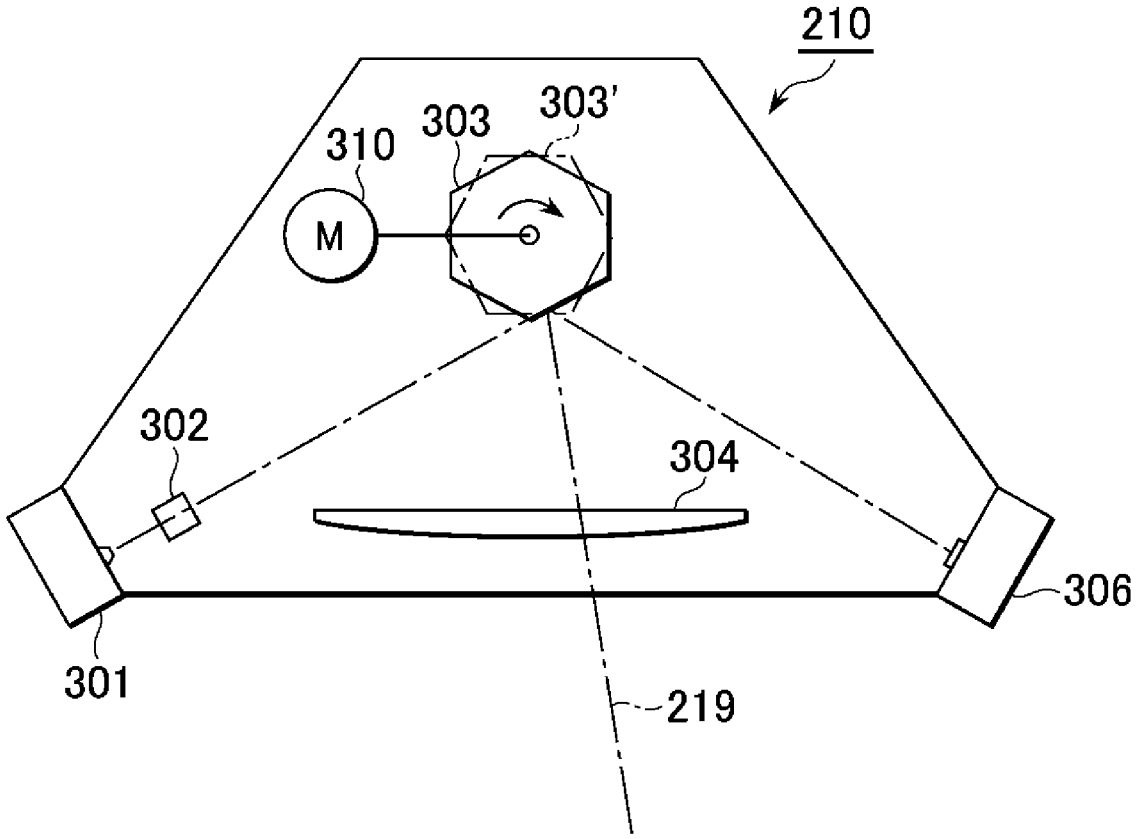
FIG. 3 is a schematic structural diagram of a laser scanner shown in FIG. 2.
Figure 4:
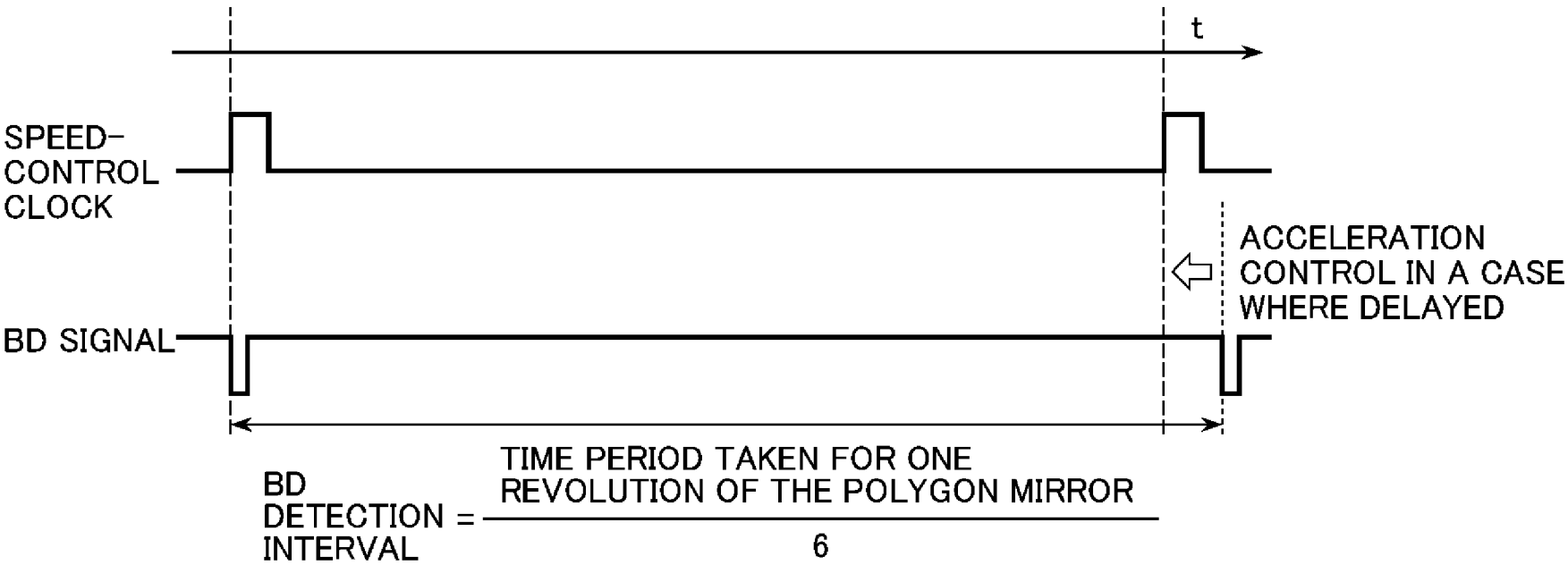
FIG. 4 is a diagram useful in explaining a polygon mirror rotational speed control using a BD sensor shown in FIG. 3.
Figure 5:
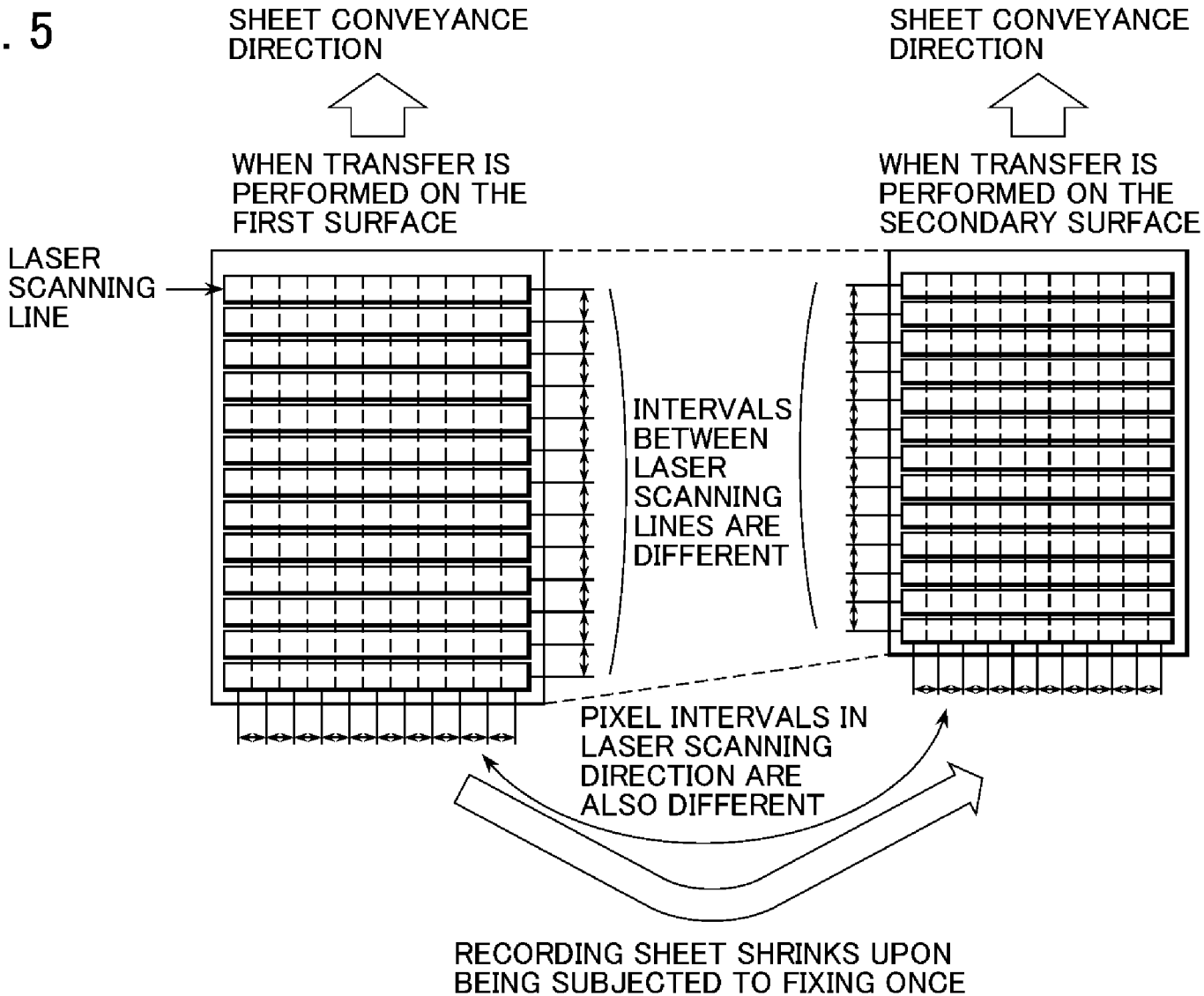
FIG. 5 is a diagram useful in explaining a change of a laser scanning control based on a shrink of a recording sheet.

FIG. 3 is a schematic structural diagram of the laser scanner 210 shown in FIG. 2. FIG. 4 is a diagram useful in explaining a polygon mirror rotational speed control using a BD sensor shown in FIG. 3. FIG. 5 is a diagram useful in explaining a change of a laser scanning control based on a shrink of a recording sheet.

In FIG. 3, the laser light emitted from a semiconductor laser 301 is shaped by a collimator lens (not shown) and a cylindrical lens 302 into a shape appropriate for emitting the photosensitive drum 211. The shaped laser light is reflected by a polygon mirror 303 rotating at a fast speed, and is shaped again by an fθ lens 304 so that the photosensitive drum 211 is scanned at a constant speed. It should be noted that the polygon mirror 303 consists of six reflecting surfaces.

The laser light 219 shaped again by the fθ lens 304 is reflected by a reflecting mirror 305 (FIG. 2), and scans the surface of the photosensitive drum 211. The rotation of the polygon mirror 303 makes the reflected light from the polygon mirror 303 into a scanning light scanning the surface of the photosensitive drum 211. A BD (Beam Detector) sensor 306 is generally used to detect a position of the scanning light. When the BD sensor 306 detects the laser light, the rotating polygon mirror 303 is at a position indicated by a broken line 303' in FIG. 3. Thus, the position of the scanning light can be calculated from a rotational speed of the polygon mirror 303 and a time period that elapses after the BD sensor 306 detects the laser light. With the use of this, a desired latent image can be formed on the photosensitive drum 211 by performing on and off control of the laser light.

The BD sensor 306 is also used to control the rotational speed of the polygon mirror 303. In a case where the polygon mirror 303 is stably rotating at a constant speed, the BD sensor 306 detects the laser light at a constant interval. As shown in FIG. 4, in a case where the BD sensor 306 detects the laser light at the time later than a periodic signal of a speed-control clock, the CPU 101 determines that the rotational speed of the polygon mirror 303 has dropped. Then, the CPU 101 increases a driving voltage of a polygon motor 310 for rotating the polygon mirror 303 so as to increase the rotational speed of the polygon mirror 303 (an acceleration control). On the other hand, in a case where the BD sensor 306 detects the laser light at the time earlier than the periodic signal of the speed-control clock, the CPU 101 decreases the driving voltage of the polygon motor 310 so as to decrease the rotational speed of the polygon mirror 303 (a deceleration control).

In a case where the both-sides printing is performed on the recording sheet, the moisture contained in the recording sheet evaporates to cause the recording sheet to shrink at a predetermined rate during the fixing processing of the recording sheet having the toner image transferred onto the first surface (a front surface) thereof. A degree of shrinking at this moment varies depending on the type of the recording sheet and the orientation of fibers thereof, but the recording sheet shrinks by approximately 0.2 to 0.8%. Thus, as shown in FIG. 5, it is necessary to previously reduce, by an amount of shrinking of the recording sheet, an image size of the toner image to be transferred onto the second surface (a back surface) of the recording sheet, i.e. a surface opposite to the first surface, from an image size of the toner image to be transferred onto the first surface. That is, the amount of shrinking in a rotational direction of the photosensitive drum 211 (a conveyance direction of the recording sheet) can be compensated by increasing the rotational speed of the polygon mirror 303 and shortening an interval of laser scanning lines during the image formation on the second surface according to the shrinking of the recording sheet occurring along with the image formation on the first surface. In addition, an amount of shrinking in a main-scanning direction of the laser can be compensated by increasing an image clock in a laser scanning line to increase a pixel density in one laser scanning line according to the shrinking of the recording sheet occurring along with the image formation on the first surface. As hereinabove described, the rotational speed of the polygon mirror and the image clock in the laser scanning line are increased according to the shrinking of the recording sheet occurring along with the image formation on the first surface. Thus, without changing image information, an image can be formed according to an amount of shrinking of the recording sheet occurring along with the image formation on the first surface of the recording sheet.

Next, a both-sides image forming sequence (a both-sides image forming processing) will be hereinafter described with reference to FIGS. 6 to 13.

FIGS. 6 to 9 are views for illustrating the both-sides image forming sequence in a block circulation. The block circulation will be later described.

The digital printing machine according to the present embodiment has two both-sides image forming sequences. These both-sides image forming sequences will be hereinafter described using a case of performing a following print job as an example. The print job specifies that: the source of sheet-feeding=right deck 221 (sheet size=A4 (210 mm×297 mm)); the number of sheets=16 sheets; the post-processing=none; and a sheet-discharging destination=the sheet discharging tray 274.

The first both-sides image forming sequence is a method called the block circulation (the first both-sides image forming processing).

Figure 6:
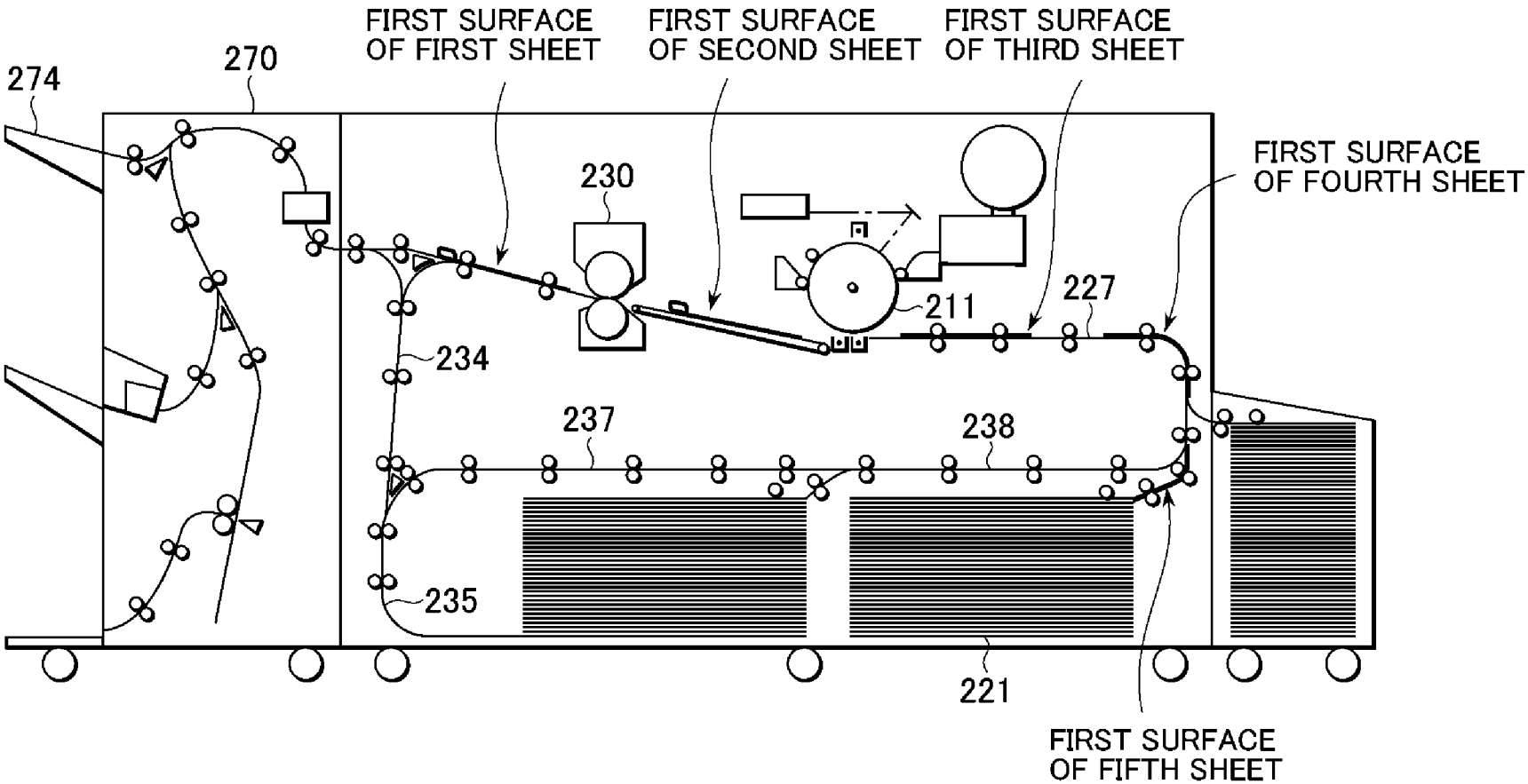
FIG. 6 is a view illustrating an initial conveyance state of recording sheets in a block circulation in the digital printing machine.
Figure 7:
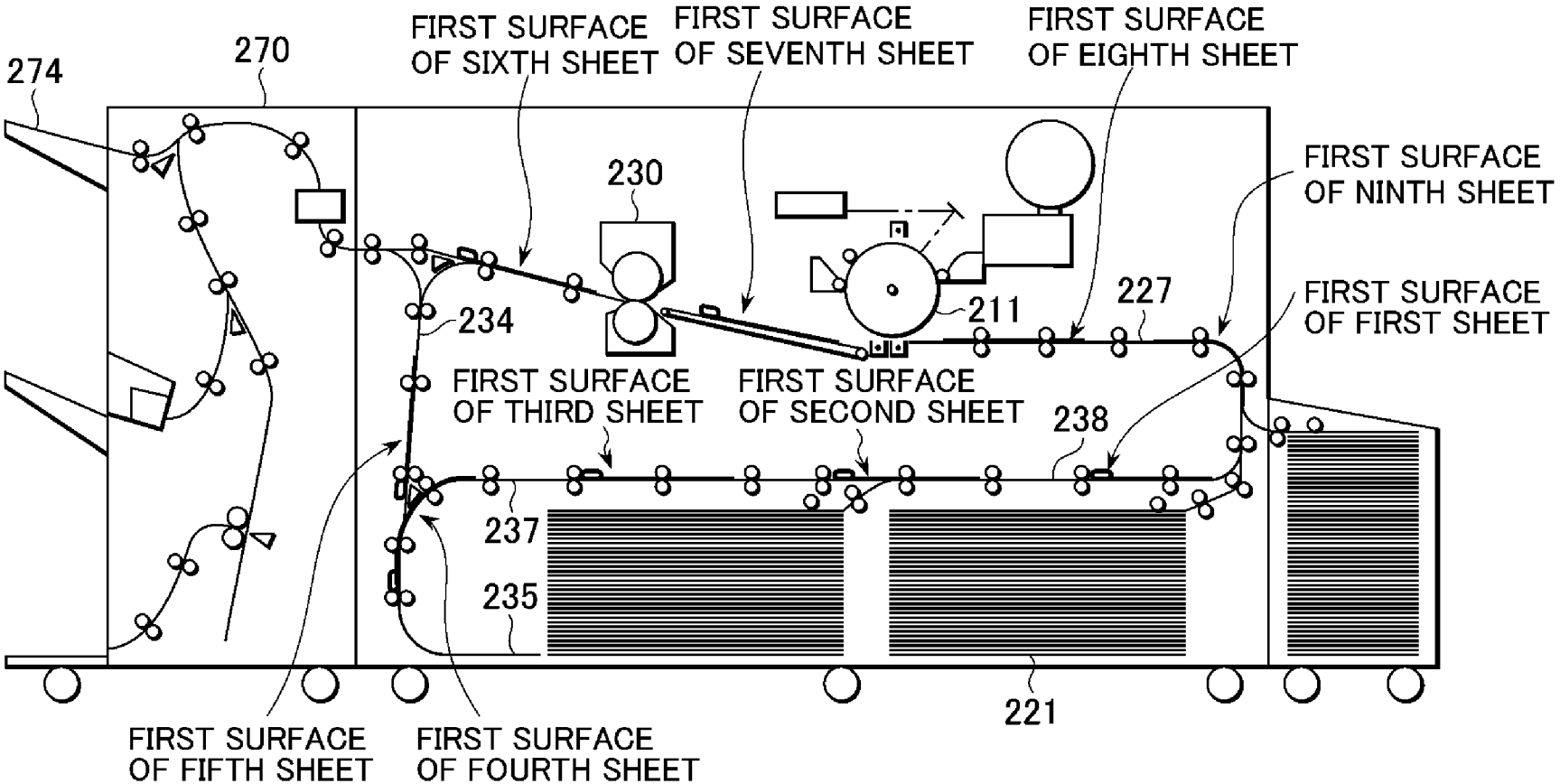
FIG. 7 is a view illustrating a middle-period conveyance state of the recording sheets in the block circulation in the digital printing machine.

First, a plurality of recording sheets are successively fed from the right deck 221, and the image formation is successively performed for a plurality of times on each of the first surfaces of the plurality of recording sheets (FIG. 6). The successive feeding from the right deck 221 stops, when the first recording sheet reaches the re-feeding path 238 by way of the fixing device 230, the reversing path 234, the both-sides reversing path 235, and the lower conveyance path 237 (FIG. 7). At this moment, nine recording sheets have been fed from the right deck 221. Thereafter, the first recording sheet having an image formed on the first surface thereof is conveyed from the re-feeding path 238 to the main conveyance path 227, and an image is formed on the second surface (the secondary surface) thereof. Then, the first recording sheet is conveyed to the finisher 270, and is discharged to the sheet discharging tray 274.

Figure 8:
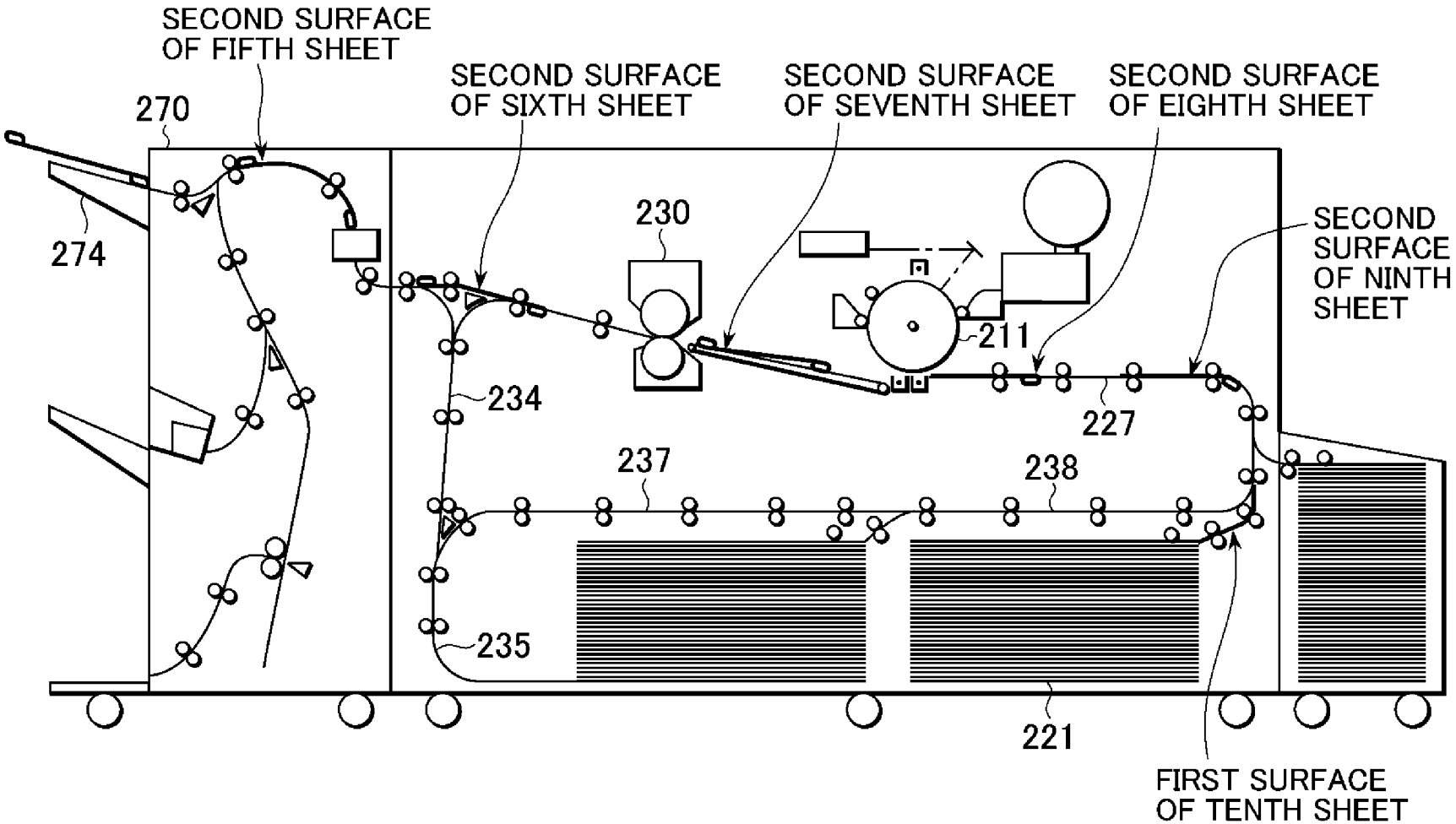
FIG. 8 is a view illustrating a later-period conveyance state of the recording sheets in the block circulation in the digital printing machine.
Figure 9:
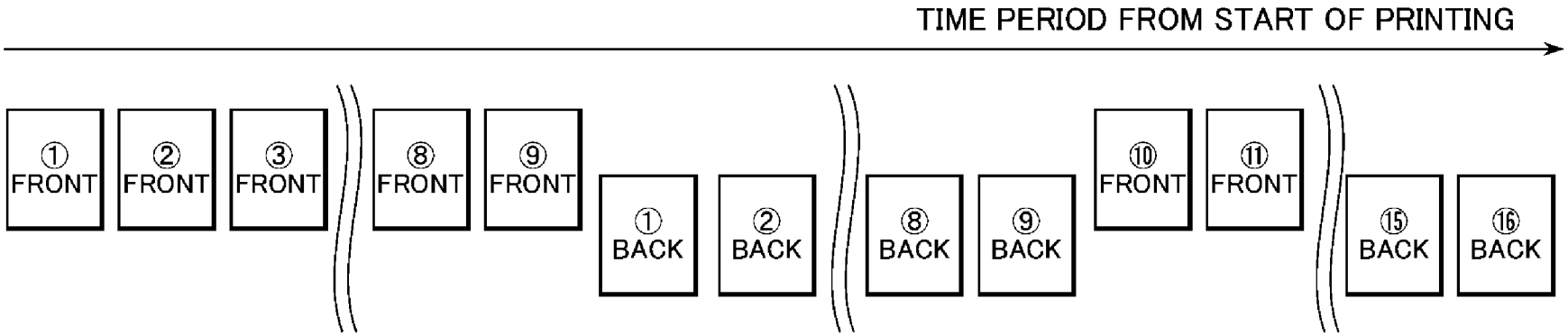
FIG. 9 is a view showing a series of recording sheets subjected to image formation during the block circulation.

In the above-described both-sides printing in which nine sheets are treated as one set, when the ninth recording sheet has been conveyed from the re-feeding path 238 to the main conveyance path 227, the tenth recording sheet is fed from the right deck 221 so that a subsequent set of both-sides printing starts (FIG. 8). Thereafter, the both-sides printing on nine sheets as one block is repeated. In a case of the both-sides printing on sixteen sheets, after nine sheets as one block have been printed, seven sheets remains. Thus, the both-sides printing is performed on the seven sheets as one block. FIG. 9 is a view showing a series of recording sheets subjected to image formation during the block circulation as described above.

As FIG. 9 shows, when the image formation has been successively performed on the first surfaces (the front surfaces) of nine recording sheets, the image formation is performed on the secondary surface (the back surface) of the first recording sheet after the image formation is performed on the first surface of the ninth recording sheet. Then, the image formation is performed on the first surface of the tenth recording sheet after the image formation is performed on the secondary surface of the ninth recording sheet. When the image formation moves on from the first surface (the front surface) of the ninth recording sheet to the secondary surface (the back surface) of the first recording sheet, an image forming interval becomes wider. On the other hand, when the image formation moves on from the secondary surface of the ninth recording sheet to the first surface of the tenth recording sheet, the image forming interval is back to the initial condition. As described above, this is because the rotational speed of the polygon mirror 303 is changed according to the shrinking of the recording sheet. However, because the polygon mirror 303 used in the digital printing machine as described above has a large inertia to be able to stably rotate, it takes a lot of time for the polygon mirror 303 to stabilize its rotation when the polygon mirror 303 changes the rotational speed. Thus, in a case where a shrinking rate of the recording sheet is larger than a predetermined value, a distance (or a time period) between recording sheets is kept larger when the rotational speed of the polygon mirror 303 is changed than when the rotational speed is not changed, namely in normal times. In this way, it is made sure that the rotational speed of the polygon mirror 303 can be reliably changed.

The both-sides image forming sequence in the block circulation as described above can achieve the fastest processing, i.e., the both-sides printing treating nine sheets as one set, for a print job that does not require any post-processing. However, the block circulation may sometimes be unable to perform a fast printing processing for a print job specifying a post-processing in the finisher. A case will be described later where it becomes impossible to perform a fast printing processing in the block circulation, and a switching operation of the both-sides image forming sequence occurring along therewith will also be described later.

It should be noted that the image forming interval may also be considered as a transfer interval onto the recording sheet or a sheet-discharging interval from the image forming apparatus to the finisher.

FIGS. 10 to 13 are views showing the both-sides image forming sequence in an alternate circulation.

The second both-sides image forming sequence is a method called the alternate circulation (the second both-sides image forming processing).

Figure 10:
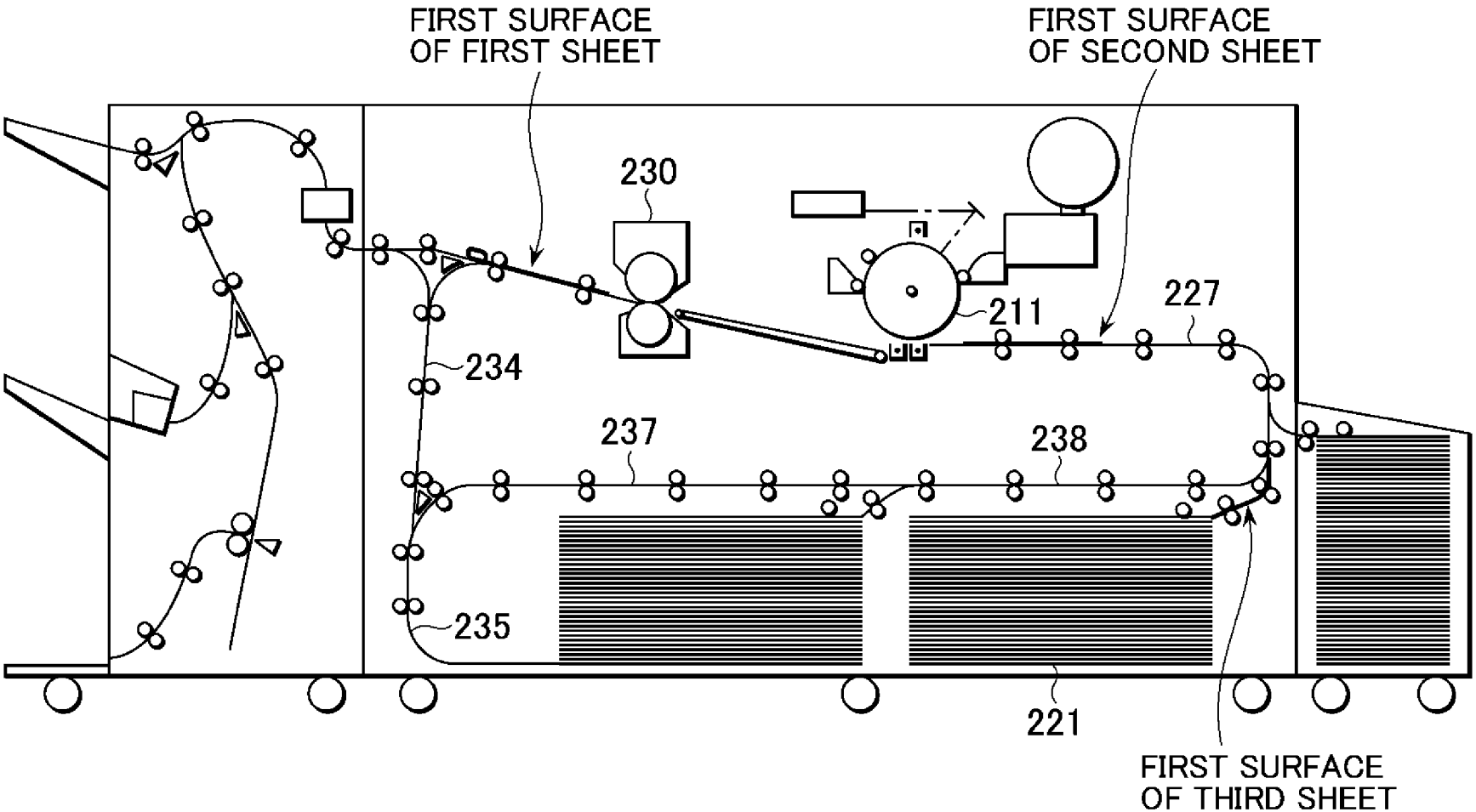
FIG. 10 is a view showing an initial conveyance state of recording sheets in an alternate circulation in the digital printing machine.
Figure 11:
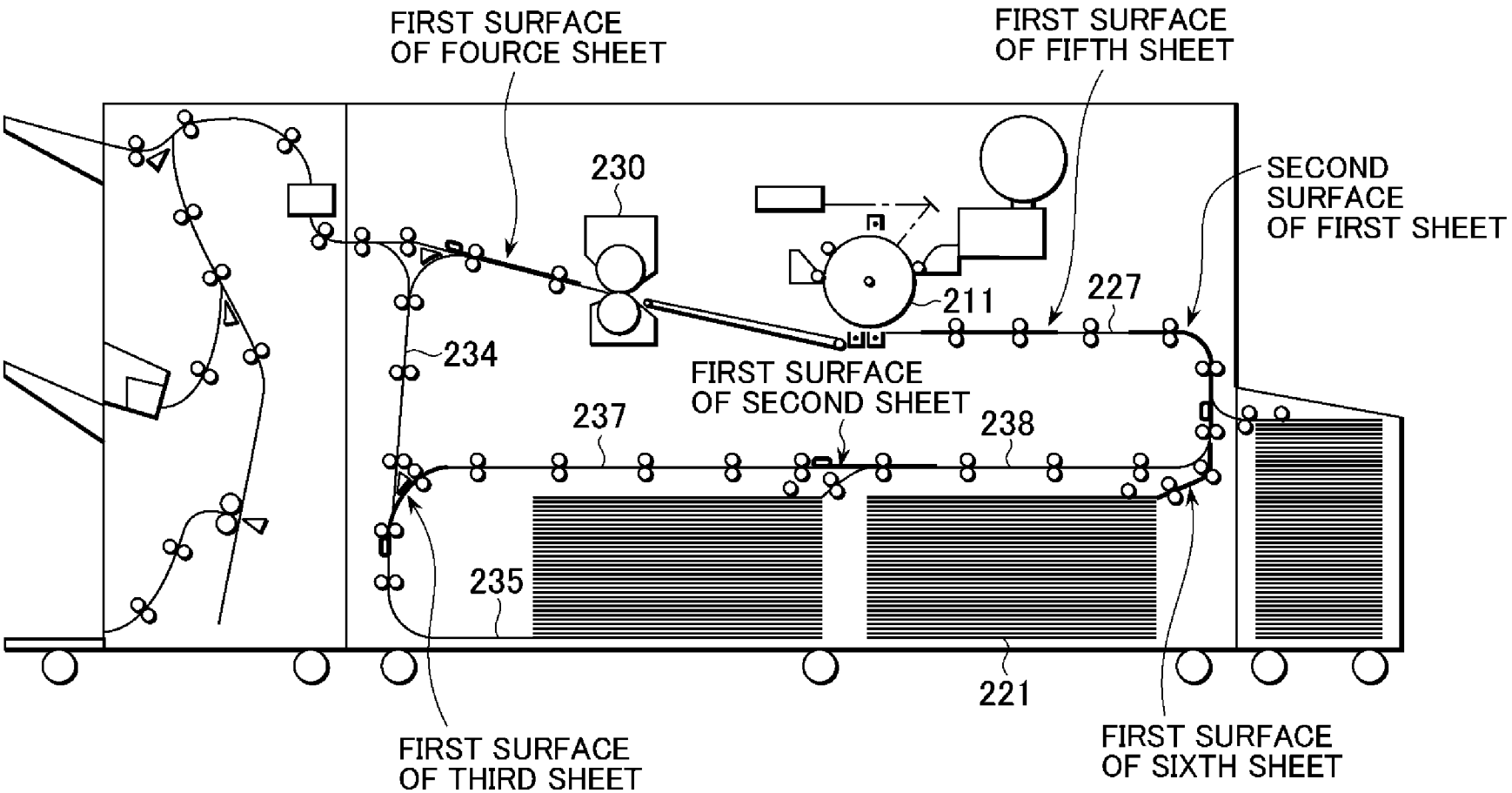
FIG. 11 is a view showing a middle-period conveyance state of the recording sheets in the alternate circulation in the digital printing machine.
Figure 12:
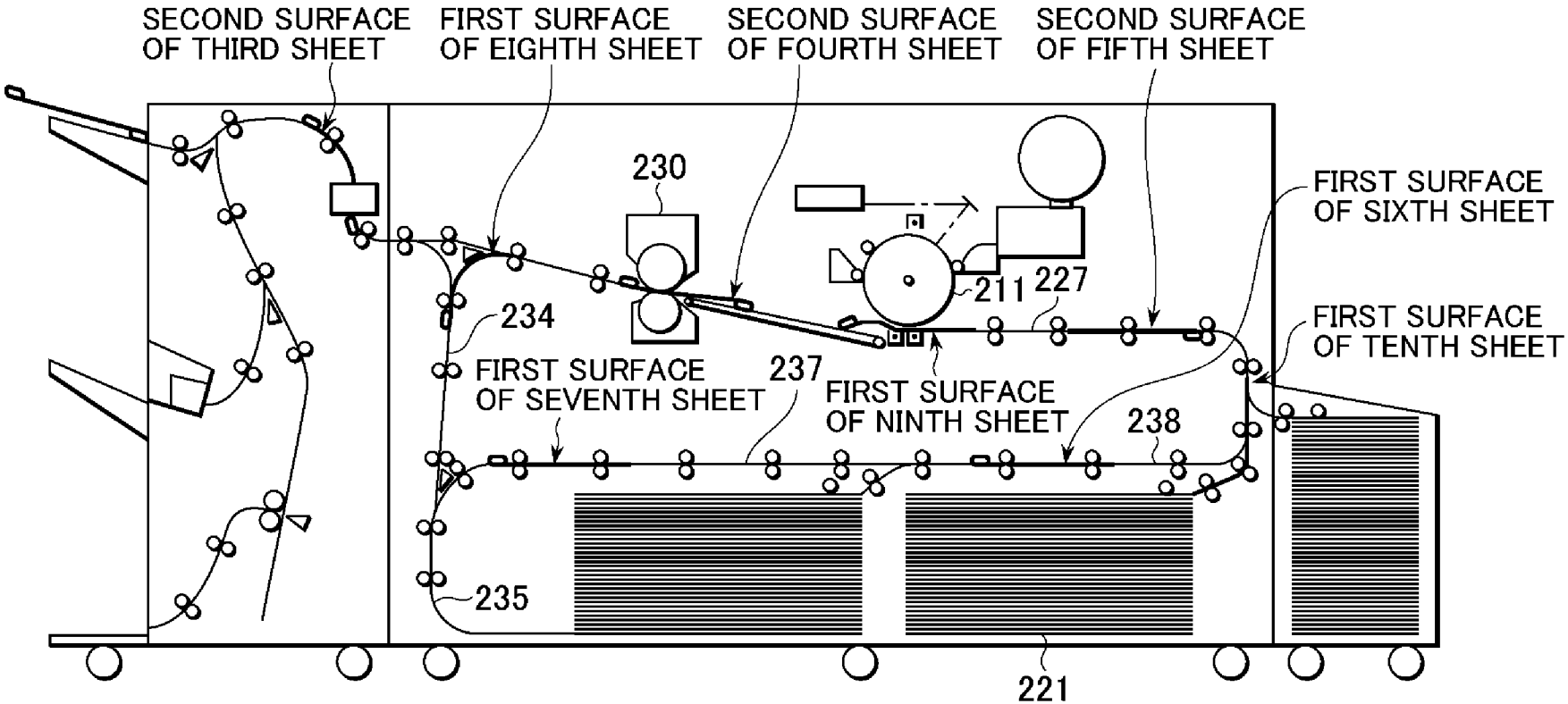
FIG. 12 is a view showing a later-period conveyance state of the recording sheets in the alternate circulation in the digital printing machine.
Figure 13:
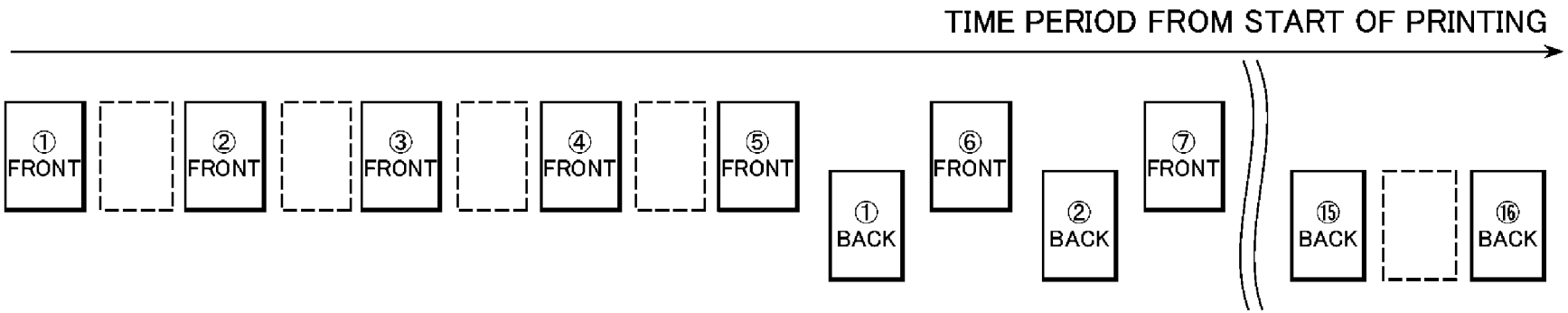
FIG. 13 is a view showing a series of recording sheets subjected to image formation during the alternate circulation.

First, a predetermined number of recording sheets are successively fed from the right deck 221, and the image formation is successively performed for the predetermined number of times on each of the first surfaces of the predetermined number of recording sheets (FIG. 10). At this moment, the recording sheets are conveyed so that an interval between the recording sheets successively fed becomes the sum of a length of a recording sheet and twice as much as a normal interval between the recording sheets. It should be noted that the normal interval between the recording sheets is an interval between recording sheets in a case where a single-side image formation is successively performed, and is the same as the interval between the recording sheets in FIG. 6. When the first recording sheet having an image formed on the first surface thereof returns back to the re-feeding path 238, the recording sheets are thereafter alternately fed from the re-feeding path 238 and the right deck 221 to the main conveyance path 227 (FIG. 11). That is, the image formation on the secondary surface of the recording sheets fed from the re-feeding path 238 and the image formation on the first surface of the recording sheets fed from the right deck 221 are alternately performed. The interval between the recording sheets is made wider to allow one sheet to be inserted between each of the plurality of the recording sheets fed earlier, so that a recording sheet fed from the right deck 221 can be inserted between recording sheets conveyed from the re-feeding path 283. Thereafter, a control is performed so that a recording sheet having images formed on both of the primary and secondary surfaces thereof is conveyed toward the finisher 270 and that a recording sheet having an image formed only on the first surface thereof is conveyed toward the both-sides reversing path 235 via the reversing path 234 (FIG. 12). Then, the above processing is repeated until a number of sheets set by the print job have been fed from the right deck 221. FIG. 13 is a view showing a series of recording sheets subjected to image formation during the alternate circulation as described above.

As FIG. 13 shows, after the image formation is successively performed on the first surfaces of five recording sheets, the image formation is performed on the secondary surface of the first sheet, and thereafter, the image formation on the first surface and the image formation on the secondary surface are alternately performed. In the second both-sides image forming processing, after the alternate circulation starts (after the image formation on the first surface of the fifth recording sheet), the rotational speed of the polygon mirror 303 is changed for each image formation, and the image forming interval accordingly becomes wider. Thus, it takes more time to complete the print job than in the block circulation.

Next, a case where it becomes impossible to perform a fast printing processing in the block circulation will be hereinafter described using a following print job as an example.

The source of sheet-feeding: right deck 221 (sheet size=A3 (420 mm×297 mm));

The number of sheets: 15 sheets per one copy;

The post-processing: center-binding output (both-sides printing)

The sheet-discharging destination: the saddle sheet-discharging tray 285

The maximum printing capability of the digital printing machine itself according this embodiment, namely, the maximum number of the sheets for image formation per unit time, is 60 pages per minute in the single-side printing on a plain paper of A3 size. Thus, in a case where the single-side printing on the plurality of recording sheets is performed at the maximum printing capability, a time interval (the image forming interval) between front ends of recording sheets is 1000 milliseconds (=60 seconds/60 pages). Below are parameters affecting the image forming sequence in the both-sides printing.

A time period needed to change the rotational speed of the polygon mirror 303: 100 milliseconds The number of sheets printed per one cycle of the recording sheet: five sheets (which means that the number of recording sheets fed until the first recording sheet is fed and conveyed to the re-feeding path 238, in this embodiment, the primary and secondary surfaces of five sheets are printed as one set in the block circulation.)

Figure 14A:
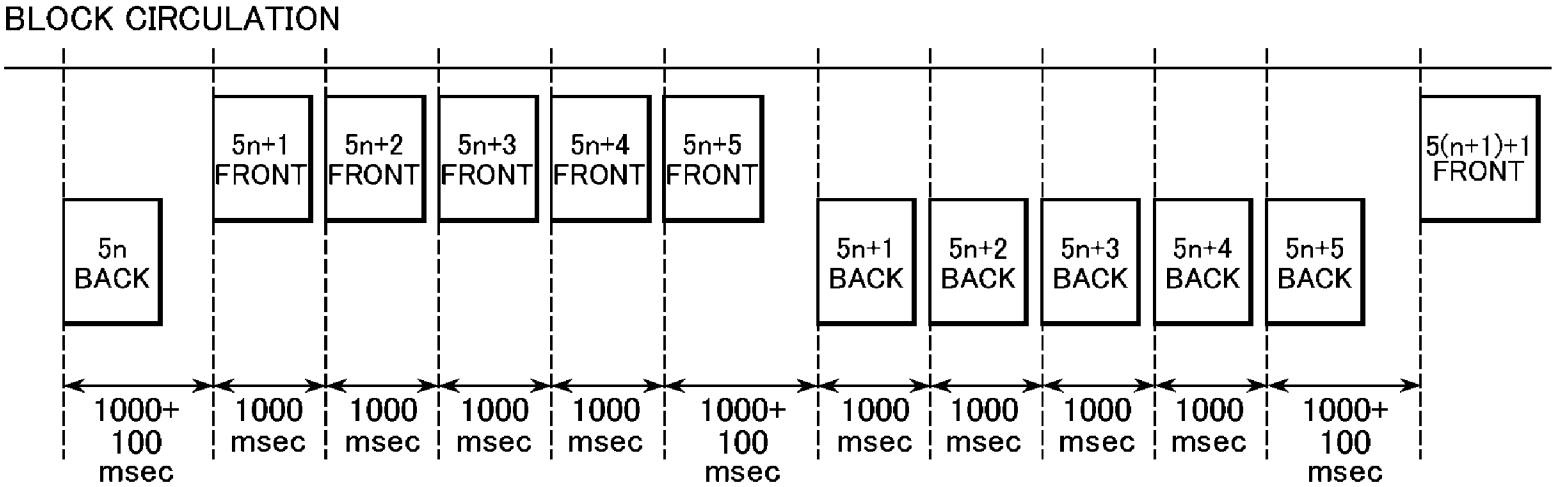
FIGS. 14A and 14B are views showing an image forming interval in a both-sides image forming sequence of the printing machine itself.
Figure 14B:
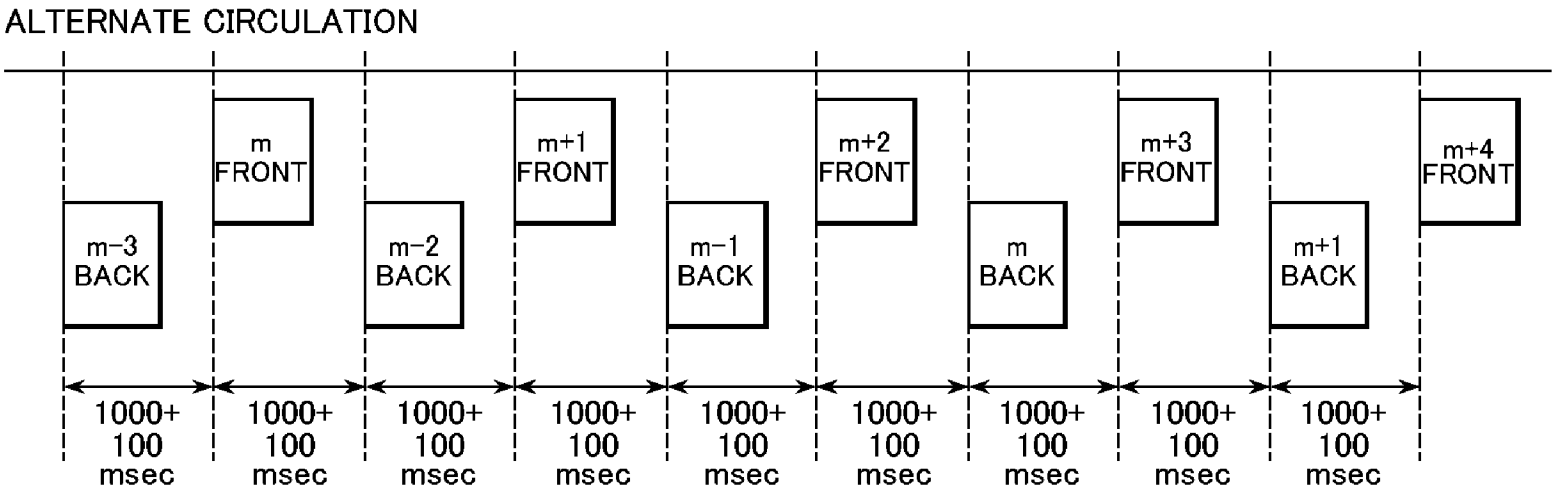

Thus, as shown in FIG. 14A and FIG. 14B, the time interval (the image forming interval) between each of the recording sheets in the set and a front end of a recording sheet therebefore is as follows (m, n are integers in FIGS. 14A and 14B).

The image forming intervals for the block circulation are set forth as below:

for only the first sheet in a set of sheets: 1100 milliseconds=1000 milliseconds+100 milliseconds;

for the remaining four sheets: 1000 milliseconds; and an average value of five sheets: 1020 milliseconds (59 pages/minute).

The image forming interval for the alternate circulation are set forth as below:

for all recording sheets: 1100 milliseconds=1000 milliseconds+100 milliseconds (55 pages/minute)

It should be noted that a variation of the rotational speed of the polygon mirror 303 is determined according to the shrinking rate and the size of the recording sheet used. Thus, a time period needed to change the rotational speed also changes according to the shrinking rate and the size of the recording sheet used. In this embodiment, the above values are set assuming a standard plain paper.

In the meantime, the processing capability of a punch in the finisher is 30 sheets/minute on the recording sheet of A3 size. Because the processing capability is determined on the assumption of the both-sides printing, the processing capability is set to be one half of a printing capability of the digital printing machine itself. Accordingly, in a case of a print job performing the punching processing, 2000 milliseconds (=60 seconds/30 sheets) or more should be taken in the time interval (the image forming interval) between front ends of recording sheets.

Figure 15:
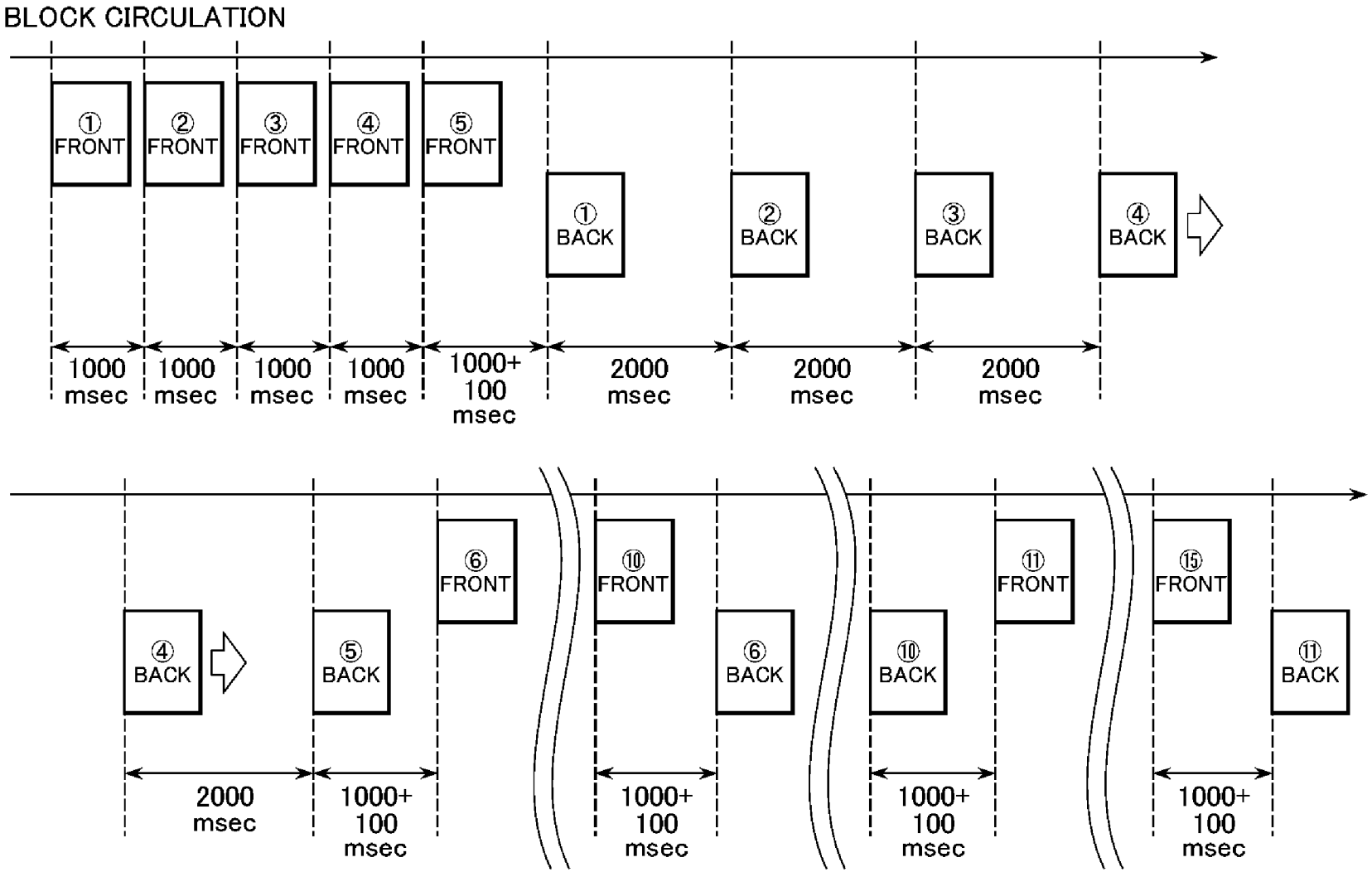
FIG. 15 is a view showing an image forming interval and recording sheets in the block circulation.

Thus, in the successive printing on the secondary surfaces where five sheets are treated as one set, the digital printing machine causes, sheet by sheet, each of the second sheet and three sheets subsequent thereto to stand by with its front end bumping against and in contact with the halted registration roller 228. Then, the digital printing machine waits to start the image formation until the interval between recording sheets needed by the finisher is obtained. It should be noted that for the image formation on the first recording sheet, it is not necessary to particularly take the image forming interval needed by the finisher because there does not exist any recording sheet previous to the first sheet or because a sufficient interval between recording sheets is already taken. As a result, as shown in FIG. 15, in a case of the block circulation, the image forming interval unfavorably becomes wider during the image formation on the secondary surfaces of recording sheets to greatly reduce the efficiency of the image forming operation during the both-sides printing. Thus, below is a time period needed to perform the image formation from the first surface of the first recording sheet to the secondary surface of the fifteenth recording sheet.

Where the image forming interval t1 during the successive image formation onto the first surfaces is set to 1000 milliseconds;

the image forming interval t2 during the successive image formation onto the second surfaces is set to 2000 milliseconds; and an interval t12 when switching between the first surface and the second surface is set to 1100 milliseconds (1000+100), $$t1\times(4\times3)+t2\times(4\times3)+t12\times5=41500$$

milliseconds (approximately 41 seconds) is obtained as the time period for the above image formation.

Next, in a case of the alternate circulation, it is necessary to change the speed of the polygon mirror when switching between the first surface and the secondary surface. Thus, the interval t21 between the image formation on the secondary surface and the subsequent image formation on the first surface is set to 1100 milliseconds.

Figure 16:
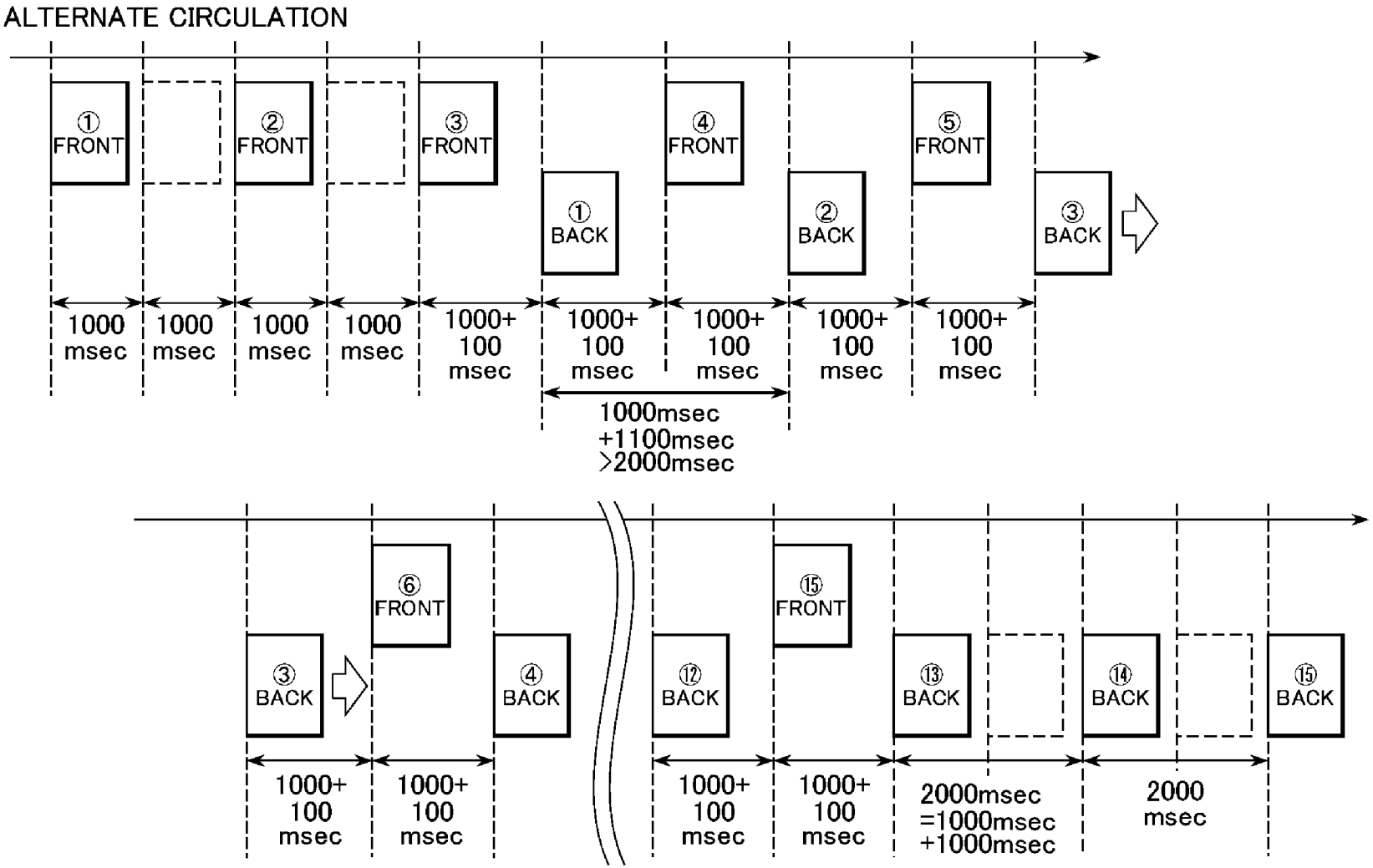
FIG. 16 is a view showing an image forming interval and recording sheets in the alternate circulation.

On the other hand, the interval t12 between the image formation on the first surface and the subsequent image formation on the secondary surface is also set to 1100 milliseconds which is the same value as the interval t21. In this case, an interval between the first and second recording sheets discharged to the finisher is 2200 milliseconds, which is longer than 2000 milliseconds which is a time period needed for performing the punching processing. Thus, it is not necessary to further extend the image forming interval for the post-processing. The exception is that when the image formation is performed on the secondary surfaces of only the last two sheets in the print job, it is necessary to take a time period for performing the punching processing because there does not exist any recording sheet subjected to the image formation of the first surface. As a result, as shown in FIG. 16, in a case of the alternate circulation, it is not necessary to take a time period needed for performing the punching processing except for the last two sheets in the print job. Thus, there does not exist any factor that delays the image forming operation except for a time period for changing the speed of the polygon mirror. Accordingly, calculated by below equation is value of a time period needed to perform the image formation from the first surface of the first sheet to the secondary surface of the fifteenth sheet.

$t1\times(2\times2)+t12\times(15\times2-5)+t2\times2=35900$ milliseconds (approximately 36 seconds)

In this way, in a case of a print job specifying the center-binding processing, a time period needed for performing the image formation in the alternate circulation becomes shorter than a time period needed for performing the image formation in the block circulation.

As can be seen from the both-sides image forming sequence as described above, in a case where a set print job includes an execution instruction for a post-processing for which the number of sheets processed per unit time is a few, the image forming operation during the both-sides printing can be efficiently performed if the both-sides image forming sequence is performed in the alternate circulation.

Next, a processing for selecting either of two types of both-sides image forming sequences according to the configuration of a print job will be hereinafter described with reference to FIG. 17.

Figure 17:
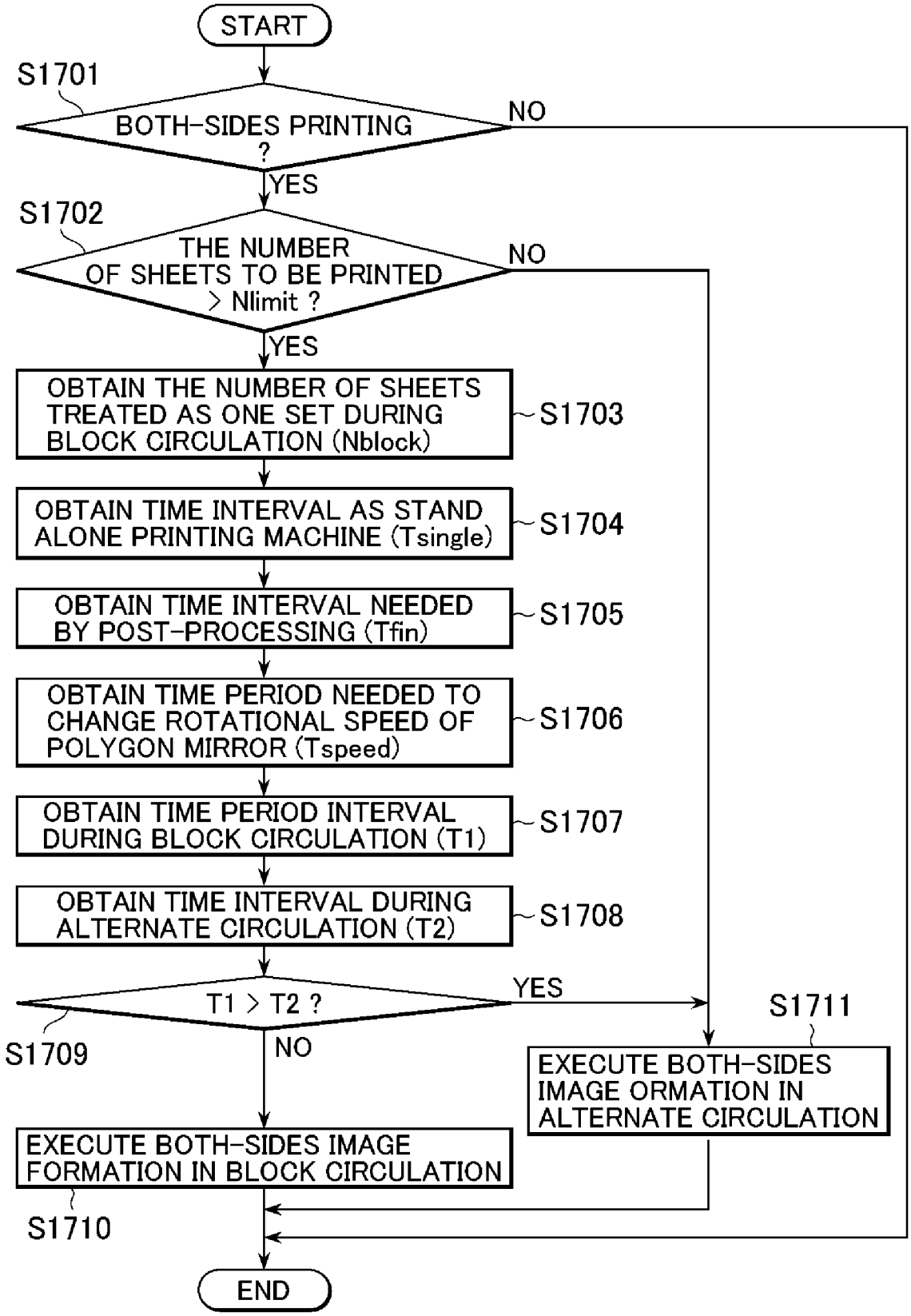
FIG. 17 is a flowchart showing a procedure of a selection processing of the both-sides image forming sequence.

FIG. 17 is a flowchart showing a procedure of a selection processing of the both-sides image forming sequence. The CPU 101 (a both-sides image forming processing selection means) executes a control program read out of a memory to perform this processing.

First, the CPU 101 determines whether or not the set print job is the both-sides printing (step S1701). In a case where the set print job is the both-sides printing (YES in step S1701), the CPU 101 seeks the number of recording sheets to be subjected to image formation, and determines whether or not the number of recording sheets exceeds a predetermined number of sheets (Nlimit). Then, in a case where the number of recording sheets exceeds the predetermined number of sheets (Nlimit) (YES in step S1702), the CPU 101 obtains the number of sheets treated as one set during the block circulation (=Nblock) based on the sheet size of the recording sheet to be subjected to image formation (step S1703). It should be noted that the number of sheets Nblock is obtained by referring to a table previously memorized in the ROM 102 corresponding the sheet size. On the other hand, in a case where the number of recording sheets to be subjected to image formation is equal to or less than the predetermined number of sheets (Nlimit) (NO in step S1702), the CPU 101 performs the both-sides image forming sequence in the alternate circulation (step S1711). The reason why the alternate circulation is selected is that even in a case of a print job not specifying any post-processing, there exists little difference between a time period needed to perform the both-sides image formation in the alternate circulation and a time period needed to perform the both-sides image formation in the block circulation.

Next, in step S1704, the CPU 101 obtains the image forming interval needed during the single-side printing performed as a stand-alone digital printing machine (=Tsingle) from the ROM 102. Herein, Tsignle is determined based on the printing capability of the digital printing machine, i.e., the number of sheets for image formation per unit time, and is previously recorded in the ROM 102. Subsequently, in step S1705, the CPU 101 obtains the image forming interval needed to perform a post-processing such as the finisher and the like (=Tfin) from the ROM 102. Herein, Tfin is determined based on the number of sheets processed in a unit time by the post-processing specified by the set print job, and is previously recorded in the ROM 102. Next, in step S1706, the CPU 101 obtains a time period for changing rotational speed of the polygon mirror 303 (=Tspeed) from the ROM 102.

Figure 18:
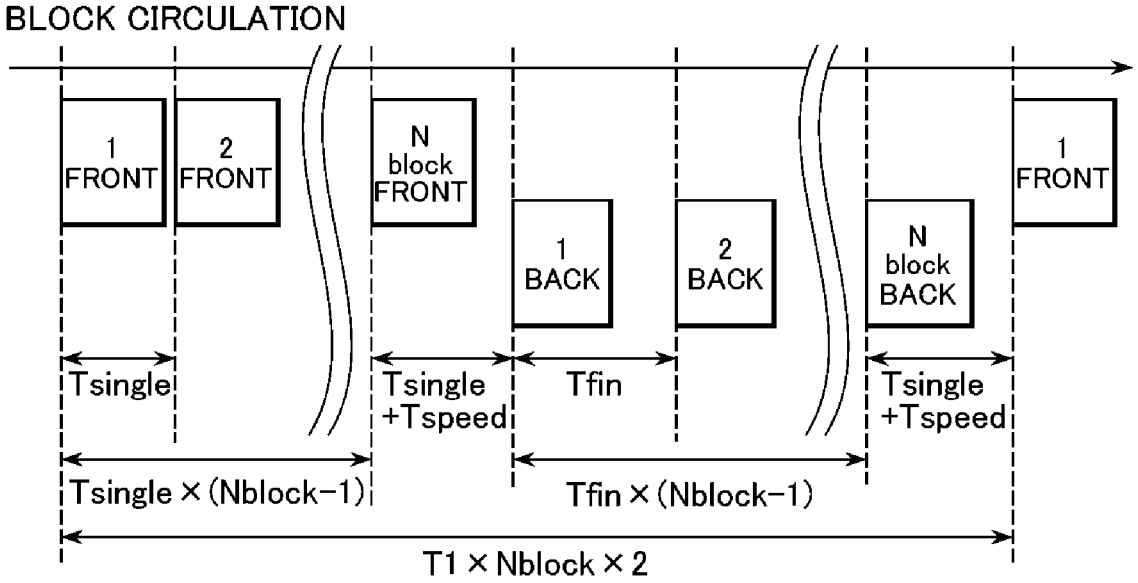
FIG. 18 is a diagram useful in explaining a calculation method for obtaining a time period needed for the block circulation.
Figure 19:
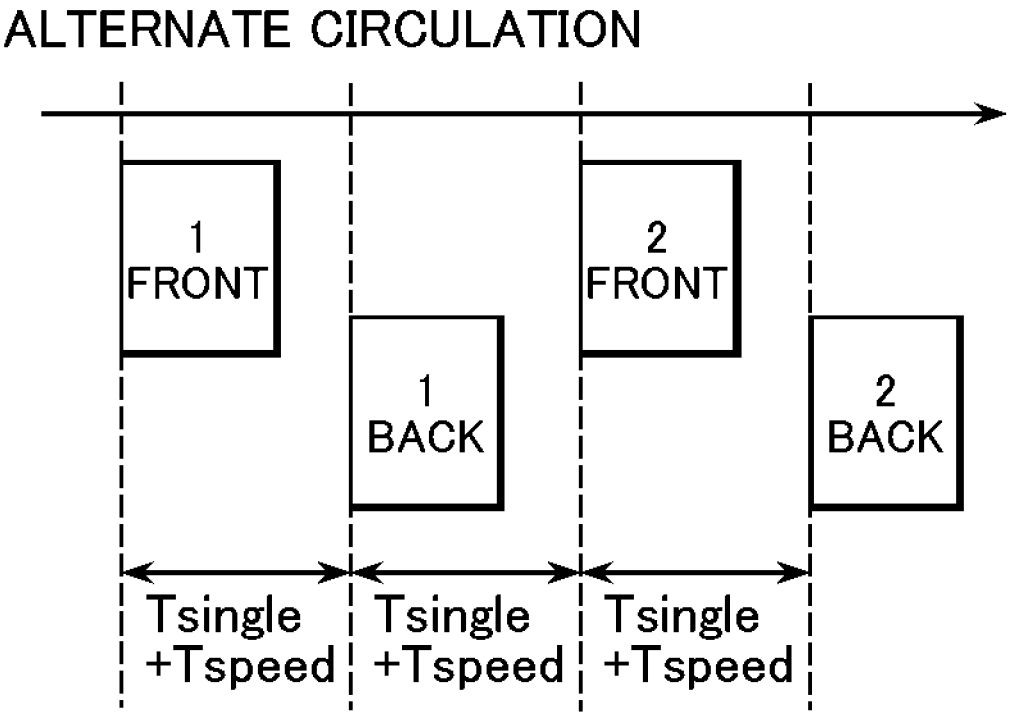
FIG. 19 is a diagram useful in explaining a calculation method for obtaining a time period needed for the alternate circulation.
Figure 19:
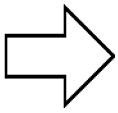

Next, the CPU 101 seeks a time period T1 (the first time period) needed per the number of sheets in one set during the block circulation using a formula shown in FIG. 18 based on information obtained in steps S1703 to S1706 (step S1707). Similarly, the CPU 101 seeks a time period T2 (the second time period) needed during the alternate circulation using a formula shown in FIG. 19 (step S1708). The CPU 101 compares the time periods T1, T2 obtained in these steps S1707, S1708. In a case where T2 is smaller than T1 (YES in step S1709), the CPU 101 selects to perform the both-sides image forming sequence in the alternate circulation. On the other hand, in a case where T1 is equal to or less than T2 in step S1709 (NO in step S1709), the CPU 101 selects to perform the both-sides image forming sequence in the block circulation. It should be noted that in the alternate circulation, a time period for successively forming images on the first surfaces of recording sheets and a time period for successively forming images on the secondary surfaces of recording sheets are excluded from the calculation of T2. In addition, in the block circulation, a time period from when starting the image formation of the first surface of a recording sheet in the final block to when completing the image formation in the final block is excluded from the calculation of T1. This is to simplify the calculation of T1 and T2, and is because a ratio of the above-mentioned time periods to the entirety becomes smaller as the number of sheets in a print job becomes larger.

In this way, the CPU 101 selects either of the block circulation or the alternate circulation based on a content of the post-processing and a time period needed to switch between the image formation onto the first surface of recording sheets and the image formation onto the second surface of recording sheets. Thus, the both-sides printing on the plurality of recording sheets can be efficiently performed.

Figure 20A:
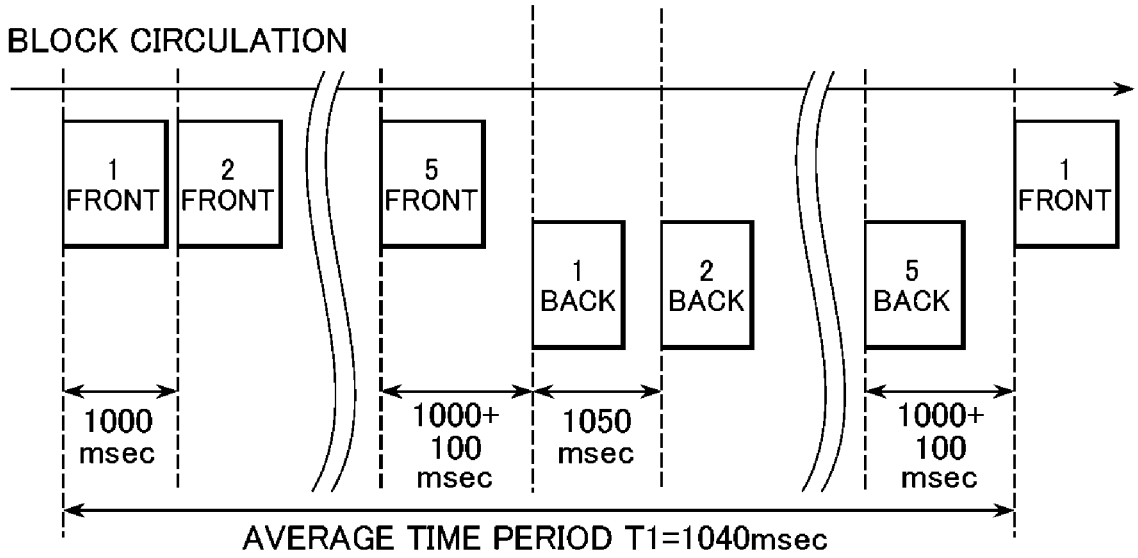
FIGS. 20A and 20B are views showing an example of a case where a required image forming interval becomes less due to a post-processing operation.
Figure 20B:
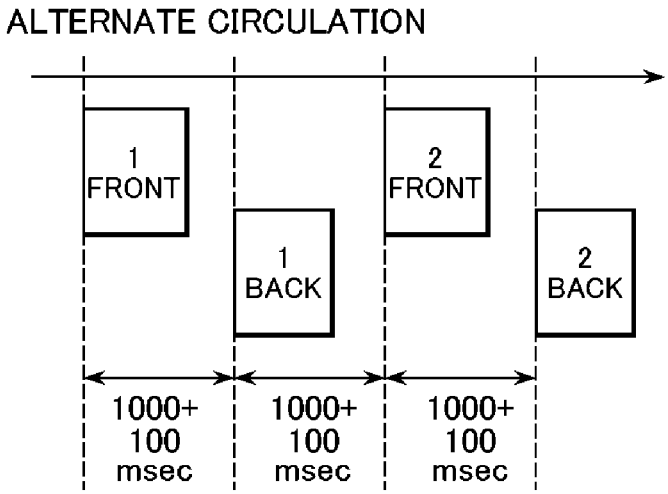

In the meantime, in a case where a print job to be executed is a job performing a post-processing on a bundle of the plurality of recording sheets such as a print job performing the center-biding processing on a bundle of recording sheets on the saddle sheet-discharging tray 285 in the finisher, the block circulation may be selected in the flowchart of FIG. 17. The processing in this case will be described using FIG. 20A and FIG. 20B.

In a case where recording sheets of A3 size are stacked on the saddle sheet discharging tray 285, a time interval between front ends of the recording sheets, which is necessary to stack the recording sheets, (the image forming interval: Tfin) is 1050 milliseconds. In addition, as shown in FIGS. 14 to 16, values of Nblock (=5), Tsingle (=1000 milliseconds), Tspeed (=100 milliseconds) are obtained. As a result, T1 is set to 1040 milliseconds, and T2 is set to 1100 milliseconds. Thus, because in step S1709 in the flowchart of FIG. 17, it is determined to be "NO", the both-sides printing in the block circulation is selected in a both-sides print job specifying to discharge sheets onto the saddle sheet discharging tray 285. In this case, after recording sheets of the first set is discharged from the digital printing machine to the finisher, it takes some time to discharge the recording sheets of the second set out of the digital printing machine because the image formation is performed onto the first surfaces of recording sheets of the second set. During this time period, the center-biding and the folding can be performed on a bundle of recording sheets of the first set. Thus, the image forming interval need not be further extended for the post-processing.

As hereinabove described, according to the digital printing machine of the first embodiment, the image forming operation during the both-sides printing can be efficiently performed by switching the both-sides image forming sequence upon making a determination based on the image forming interval needed during the single-side printing performed by the digital printing machine itself (=Tsingle), the image forming interval needed by the post-processing (=Tfin), and the time period for changing the rotational speed for the polygon mirror (=Tspeed). Furthermore, the image forming operation during the both-sides printing can be efficiently performed in a case where a post-processing apparatus is attached that has an inferior processing capability than the image forming apparatus and in a case where it takes some time to switch a target of image formation for recording sheets between the first surface thereof and the second surface thereof.

It should be noted that, instead of calculating T1, T2, each one of the time periods needed to perform the image formation in the block circulation and the time period needed to perform the image formation in the alternate circulation may be calculated so as to select the both-sides printing method requiring a shorter time period therebetween.

Second Embodiment

The digital printing machine according to the second embodiment of the present invention has the same structure as the above-described digital printing machine according to the first embodiment, and portions similar to the first embodiment are denoted with the same reference numerals without the description thereabout. Only points different from the first embodiment will be hereinafter described.

The digital printing machine according to the second embodiment has a function to enlarge the image forming interval (reduces the number of sheets subjected to image formation per unit time) in a case where the basis weight of a recording sheet is large. Because this embodiment is characterized by this function, this function will be described.

In a case where a thick sheet having the basis weight as much as 300 g/m$^2$ is used as a recording sheet, it sometimes becomes impossible to maintain the temperature on a fixing roller depending on an output image because the heat is removed by the thick sheet even where a heater in the fixing device 230 continues to operate during printing. In a case where it becomes impossible to maintain the temperature of the fixing roller, the toner image transferred onto the recording sheet cannot be sufficiently fixed on the recording sheet, and a phenomenon occurs that the toner flakes off when the recording sheets stacked on the sheet discharging tray rub against each other. Thus, a down sequence control is performed to previously enlarge the image forming interval and reduce the heat removed per unit time, so that the temperature on the fixing roller can be maintained.

In a case of a recording sheet having the basis weight exceeding 200 g/m$^2$, the digital printing machine according to this embodiment reduces the number of sheets subjected to image formation per unit time by 25% of the maximum number of sheets subjected to image formation. That is, in a case where the maximum number of sheets therefor is 60 pages/minute, the printing capability onto a recording sheet of A3 size is set to 45 pages/minute. At this moment, in order to reduce the printing capability, a recording sheet conveyed in the main conveyance path 227 is kept waiting at the registration roller 228, so that the waiting time thereof is extended.

When the above-described down sequence control is performed, a time period of extension of waiting time Tdown at the registration roller 228 is calculated by the following equation.

$$T\text{down}=(60\text{ seconds}/45\text{ pages }(=1333\text{ milliseconds}))-(60\text{ seconds}/60\text{ pages }(=1000\text{ milliseconds}))=333\text{ milliseconds}$$

Thus, only during this period, the image forming operation is kept waiting.

Figure 21:
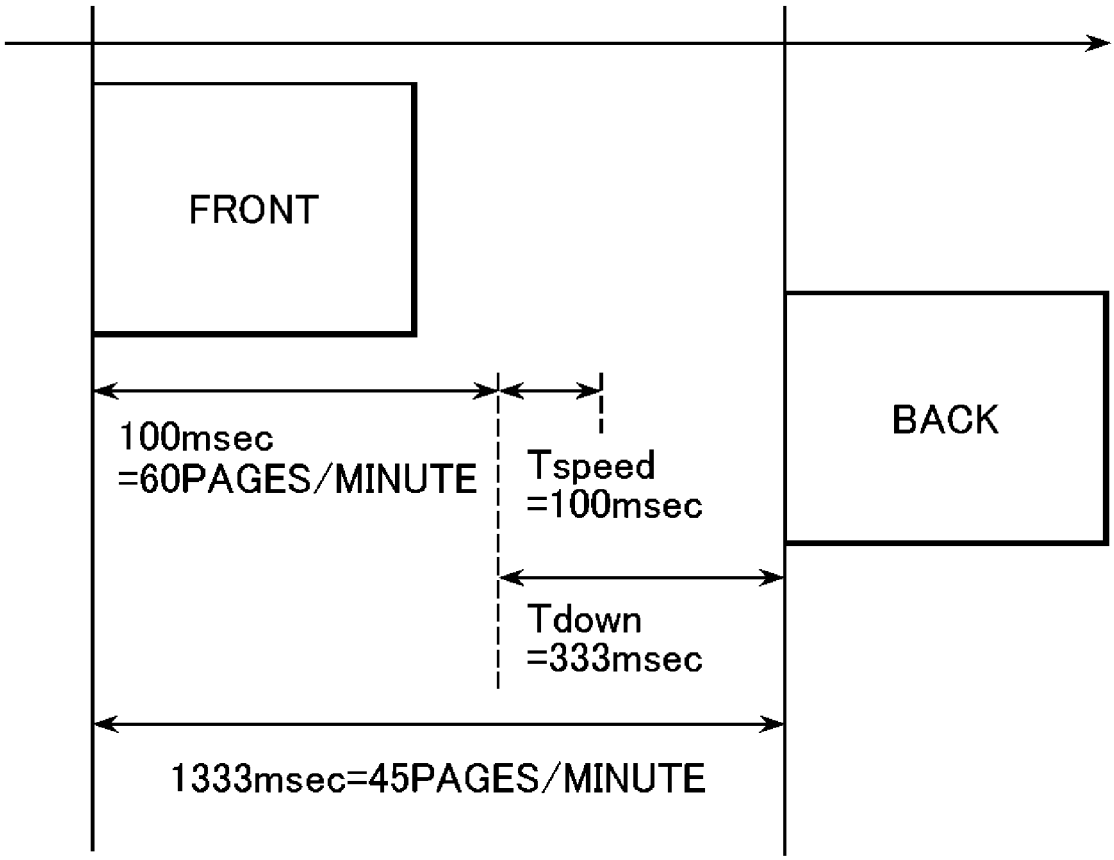
FIG. 21 is a view showing an influence exerted by the change of the polygon mirror rotational speed during a down sequence control in a case where the image formation is switched from the first surface (a front surface) to the second surface (a back surface).

As shown in FIG. 21, the above-described Tdown is sufficiently larger than the time period for changing the rotational speed of the polygon mirror Tspeed (=100 milliseconds) needed to change the rotational speed of the polygon mirror 303. Thus, the rotational speed of the polygon mirror 303 can be changed while the recording sheet is standing by at the registration roller 228. That is, the printing capability of the digital printing machine does not differ regardless of whether the both-sides image forming sequence is performed in the block circulation or in the alternate circulation. On the other hand, as described in the first embodiment, a time period needed for the image formation may be shortened by performing the both-sides image formation in the alternate circulation rather than in the block circulation, depending on a content of the post-processing. Thus, the alternate circulation should be selected while the down sequence control is performed. In contrast, in a case where the down sequence control is not performed, the both-sides image forming sequence should be selected according to the content of the post-processing as described in the first embodiment.

As hereinabove described, according to the digital printing machine of the second embodiment, the both-sides image forming sequence is performed in the alternate circulation while the down sequence control causes the image forming interval to be extended beyond a time period for changing the rotational speed of the polygon mirror 303. Thus, the both-sides printing can be efficiently performed.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium. In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2007-299652 filed Nov. 19, 2007, which is hereby incorporated by reference herein in its entirety.

What is claimed is:

1. An image forming apparatus comprising:

a first feeding unit adapted to feed a recording sheet from a container containing the recording sheet;

an image forming unit adapted to form an image on the recording sheet;

a second feeding unit adapted to re-feed to said image forming unit the recording sheet having the image formed on a first surface thereof by the image forming unit so that an image is formed on a second surface opposite to the first surface;

a post-processing unit adapted to perform a post-processing on the recording sheet having an image formed thereon;

a both-sides image formation control unit adapted to perform either of a first both-sides image forming processing or a second both-sides image forming processing by controlling said image forming unit, said first feeding unit, and said second feeding unit, wherein the first both-sides image forming processing controls, for at least one time, said first feeding unit to successively feed a plurality of recording sheets, and said image forming unit to successively form an image on the first surface of each of the plurality of recording sheets, thereafter said second feeding unit to feed the plurality of recording sheets, and said image forming unit to successively form an image on the second surface of each of the plurality of recording sheets, and the second both-sides image forming processing controls said first feeding unit to successively feed a predetermined number of recording sheets, said image forming unit to successively form an image on the first surface of each of the recording sheets, thereafter said second feeding unit and said first feeding unit to alternately feed the recording sheets, said image forming unit to alternately form an image on the second surface of the recording sheet fed from said second feeding unit and form an image on the first surface of the recording sheet fed from said first feeding unit, thereafter said second feeding unit to feed the predetermined number of recording sheets, and said image forming unit to form an image on the second surface of each of the recording sheets;

a time period computing unit adapted to compute a first time period needed by the first both-sides image forming processing and a second time period needed by the second both-sides image forming processing in a case where said post-processing unit performs the post-processing on the recording sheet formed images on both sides thereof; and a both-sides image forming processing selection unit adapted to compare the first time period and the second time period computed by said time period computing unit and adapted to select any one of the first both-sides image forming processing and the second both-sides image forming processing based on the comparison.

2. The image forming apparatus according to claim 1, wherein in the case where the first time period is shorter than the second time period, the both-sides image forming processing selection unit is adapted to select the first both-sides image forming processing.

3. The image forming apparatus according to claim 1, wherein said image forming unit includes a polygon mirror causing a light for forming a latent image to scan an image bearing member and also includes a driving device rotating the polygon mirror, and wherein the driving device is controlled to change a rotational speed of the polygon mirror when the image forming apparatus switches between image formation on the first surface of the recording sheet and image formation on the second surface of the recording sheet.

4. The image forming apparatus according to claim 3, wherein said both-sides image forming processing selection unit comprises:

a first image forming interval obtaining unit adapted to obtain, based on a number of sheets of image formation performed by said image forming unit per unit time, a first image forming interval needed during a single-side printing on a plurality of recording sheets;

a second image forming interval obtaining unit adapted to obtain, based on a number of sheets processed by the post-processing unit per unit time, a second image forming interval needed to execute the post-processing; and a rotational speed changing time period obtaining unit adapted to obtain a rotational speed changing time period needed to change the rotational speed of the polygon mirror, wherein the first time period and the second time period are obtained using at least one of the first image forming interval, the second image forming interval, and the rotational speed changing time period.

5. The image forming apparatus according to claim 4, wherein said image forming unit reduces, according to a basis weight of the recording sheet on which the image is formed, the number of sheets of image formation per unit time from a maximum number of sheets of image formation performed by said image forming unit per unit time.

6. An image forming apparatus comprising:

a first feeding unit adapted to feed a recording sheet from a container containing the recording sheet;

an image forming unit adapted to form an image on the recording sheet;

a second feeding unit adapted to re-feed to said image forming unit the recording sheet having the image formed on a first surface thereof by said image forming unit so that an image is formed on a second surface opposite to the first surface;

a post-processing unit adapted to perform a post-processing on the recording sheet having an image formed thereon;

a both-sides image formation control unit adapted to perform either of a first both-sides image forming processing or a second both-sides image forming processing by controlling said image forming unit, said first feeding unit, and said second feeding unit, wherein said first both-sides image forming processing controls, for at least one time, said first feeding unit to successively feed a plurality of recording sheets, and said image forming unit to successively form an image on the first surface of each of the plurality of recording sheets, thereafter said second feeding unit to feed the plurality of recording sheets, and said image forming unit to successively form an image on the second surface of each of the plurality of recording sheets, and the second both-sides image forming processing controls said first feeding unit to successively feed a predetermined number of recording sheets, said image forming unit to successively form an image on the first surface of each of the recording sheets, thereafter said second feeding unit and said first feeding unit to alternately feed the recording sheets, said image forming unit to alternately form an image on the second surface of the recording sheet fed from said second feeding unit and form an image on the first surface of the recording sheet fed from said first feeding unit, thereafter said second feeding unit to feed the predetermined number of recording sheets, and said image forming unit to form an image on the second surface of each of the recording sheets; and a both-sides image forming processing selection unit adapted to select, based on a type of the post-processing, any one of the first both-sides image forming processing and the second both-sides image forming processing in a case where said post-processing unit performs the post-processing on the recording sheet having the images formed on both sides thereof.

7. The image forming apparatus according to claim 6, wherein the both-sides image forming processing selection unit adapted to select, based on a type of the recording sheet and a type of the post-processing, any one of the first both-sides image forming processing and the second both-sides image forming processing.

8. An image formation method for an image forming apparatus including a first feeding unit adapted to feed a recording sheet from a container containing the recording sheet, an image forming unit adapted to form an image on the recording sheet, a second feeding unit adapted to re-feed to said image forming unit the recording sheet having the image formed on a first surface thereof by said image forming unit so that an image is formed on a second surface opposite to the first surface, and a post-processing unit adapted to perform a post-processing on the recording sheet having the image formed thereon, the image formation method comprising:

a first both-sides image forming step of executing a first both-sides image forming processing, the first both-sides image forming processing controlling, for at least one time, said first feeding unit to successively feed a plurality of recording sheets, and said image forming unit to successively form an image on the first surface of each of the plurality of recording sheets, thereafter said second feeding unit to feed the plurality of recording sheets, and said image forming unit to successively form an image on the second surface of each of the plurality of recording sheets;

a second both-sides image forming step of executing a second both-sides image forming processing, the second both-sides image forming processing controlling said first feeding unit to successively feed a predetermined number of recording sheets, said image forming unit to successively form an image on the first surface of each of the recording sheets, thereafter said second feeding unit and said first feeding unit to alternately feed the recording sheets, said image forming unit to alternately form an image on the second surface of the recording sheet fed from said second feeding unit and form an image on the first surface of the recording sheet fed from said first feeding unit, thereafter said second feeding unit to feed the predetermined number of recording sheets, and said image forming unit to form an image on the second surface of each of the recording sheets;

a time period computing step of computing a first time period needed by the first both-sides image forming processing and a second time period needed by the second both-sides image forming processing in a case where said post-processing unit performs the post-processing on the recording sheet formed images on both sides thereof; and a both-sides image forming processing selection step of comparing the first time period and the second time period and selecting any one of the first both-sides image forming processing and the second both-sides image forming processing based on the comparison.

9. An image formation method for an image forming apparatus including a first feeding unit adapted to feed a recording sheet from a container containing the recording sheet, an image forming unit adapted to form an image on the recording sheet, a second feeding unit adapted to re-feed to said image forming unit the recording sheet having the image formed on a first surface thereof by said image forming unit so that an image is formed on a second surface opposite to the first surface, and a post-processing unit adapted to perform a post-processing on the recording sheet having the image formed thereon, the image formation method comprising:

a first both-sides image forming step of executing a first both-sides image forming processing, the first both-sides image forming processing controlling, for at least one time, said first feeding unit to successively feed a plurality of recording sheets, and said image forming unit to successively form an image on the first surface of each of the plurality of recording sheets, thereafter said second feeding unit to feed the plurality of recording sheets, and said image forming unit to successively form an image on the second surface of each of the plurality of recording sheets;

a second both-sides image forming step of executing a second both-sides image forming processing, the second both-sides image forming processing controlling said first feeding unit to successively feed a predetermined number of recording sheets, said image forming unit to successively form an image on the first surface of each of the recording sheets, thereafter said second feeding unit and said first feeding unit to alternately feed the recording sheets, said image forming unit to alternately form an image on the second surface of the recording sheet fed from said second feeding unit and form an image on the first surface of the recording sheet fed from said first feeding unit, thereafter said second feeding unit to feed the predetermined number of recording sheets, and said image forming unit to form an image on the second surface of each of the recording sheets; and a both-sides image forming processing selection step of selecting, based on a type of the post-processing, any one of the first both-sides image forming processing and the second both-sides image forming processing in a case where said post-processing unit performs the post-processing on the recording sheet having the images formed on both sides thereof.

* * * * *